US011435701B2

(12) United States Patent
Nakajima

(10) Patent No.: US 11,435,701 B2
(45) Date of Patent: Sep. 6, 2022

(54) ELECTRONIC WATCH

(71) Applicant: Seiko Epson Corporation, Tokyo (JP)

(72) Inventor: Yasuo Nakajima, Matsumoto (JP)

(73) Assignee: Seiko Epson Corporation

( * ) Notice: Subject to any disclaimer, the term of this patent is extended or adjusted under 35 U.S.C. 154(b) by 330 days.

(21) Appl. No.: 16/716,588

(22) Filed: Dec. 17, 2019

(65) Prior Publication Data

US 2020/0192298 A1 Jun. 18, 2020

(30) Foreign Application Priority Data

Dec. 18, 2018 (JP) ..... JP2018-236296

(51) Int. Cl.

| | |
|---|---|
| ***G04C 10/02*** | (2006.01) |
| ***G04G 21/04*** | (2013.01) |
| ***G04G 17/04*** | (2006.01) |

(52) U.S. Cl.

CPC ..... *G04C 10/02* (2013.01); *G04G 17/04* (2013.01); *G04G 21/04* (2013.01)

(58) Field of Classification Search

CPC ..... G04G 17/04; G04G 21/04; G04G 619/00; G04G 17/06; G04C 10/02; G04C 17/0066; G04C 3/146; G04R 60/12; G04R 60/10; G04R 20/02; G04R 19/06; G04R 19/065

See application file for complete search history.

(56) References Cited

U.S. PATENT DOCUMENTS

| | | | | |
|---|---|---|---|---|
| 10,802,448 | B2 * | 10/2020 | Sawada | G04G 17/08 |
| 2015/0378313 | A1 | 12/2015 | Abe et al. | |
| 2016/0161920 | A1 * | 6/2016 | Fujisawa | G04G 17/04 368/80 |
| 2016/0204292 | A1 | 7/2016 | Saito | |
| 2017/0261944 | A1 * | 9/2017 | Fujisawa | G04R 20/04 |

FOREIGN PATENT DOCUMENTS

| | | |
|---|---|---|
| JP | 2015-072251 A | 4/2015 |
| JP | 2015-175805 A | 10/2015 |
| JP | 2017-122739 A | 7/2017 |

* cited by examiner

*Primary Examiner* — Edwin A. Leon

(74) *Attorney, Agent, or Firm* — Harness, Dickey & Pierce, P.L.C.

(57) ABSTRACT

An electronic watch includes a dial, an antenna, a solar panel, a circuit board, and a connection member. The antenna includes an antenna electrode. On the solar panel, a first solar cell and a second solar cell, are arranged continuously along an outer circumference of the antenna electrode, are connected in series via a third solar cell, which is not arranged along the outer circumference of the antenna electrode. The connection member is configured to connect the solar panel and the circuit board, and is arranged in a region different from a region in which the antenna is arranged when the dial is divided into two regions by a second virtual straight line, which is orthogonal to a first virtual straight line and passes through a center of the dial.

7 Claims, 12 Drawing Sheets

ELECTRONIC WATCH

The present application is based on, and claims priority from, JP Application Serial Number 2018-236296, filed Dec. 18, 2018, the disclosure of which is hereby incorporated by reference herein in its entirety.

BACKGROUND

1. Technical Field

The present disclosure relates to an electronic watch including an antenna and a solar panel.

2. Related Art

JP-A-2017-122739 discloses an electronic watch including a circularly polarized antenna, a solar panel including a plurality of solar cells, a secondary battery, and a circuit board electrically connected to the secondary battery, the electronic watch in which a connection position between the solar panel and the circuit board is arranged at a position away from the circularly polarized antenna.

A through hole through which a pointer shaft is inserted is formed substantially in a center of the solar panel in plan view, and division is performed with division lines provided radially from the through hole so as to obtain the solar cells. Further, in order to arrange the connection position between the solar panel and the circuit board at a position away from the circularly polarized antenna, a solar cell on a positive electrode side, which is connected to a positive electrode of the circuit board, and a solar cell on a negative electrode side, which is connected to a negative electrode, are arranged at positions away from the circularly polarized antenna.

The solar cell on the positive electrode side and the solar cell on the negative electrode side are connected in series via other solar cells arranged in a periphery of the through hole. Thus, two solar cells arranged continuously along an outer circumference of the circularly polarized antenna are directly connected in series.

An electric current is induced to the solar cells arranged along the outer circumference of the antenna so as to cancel an electric current generated at the antenna. The inventors of the present disclosure have found out a new problem. That is, when the solar cells arranged along the outer circumference of the antenna are directly connected in series, an electric current continuously flows though those solar cells, and hence an electric current flowing in a direction of canceling an electric current generated at the antenna is increased, which largely degrades receiving sensitivity of the antenna.

SUMMARY

An electronic watch according to the present disclosure includes a dial, an antenna being arranged to overlap with the dial in a plan view as seen in a vertical direction with respect to a front surface of the dial, the antenna including a dielectric base and an antenna electrode arranged on a front surface of the dielectric base, a solar panel including a first solar cell and a second solar cell being arranged to overlap with the dial in plan view and arranged continuously along an outer circumference of the antenna electrode, and a third solar cell being arranged so that at least one of the first solar cell and the second solar cell is positioned between the third solar cell and the outer circumference of the antenna electrode, the first solar cell being connected to the second solar cell in series via the third solar cell, a circuit board being arranged to overlap with the dial in plan view, and a connection member configured to connect the solar panel and the circuit board with each other, the connection member being arranged in a region different from a region in which the antenna is arranged when the dial is divided into two regions by a second virtual straight line being orthogonal to a first virtual straight line and passing through a center of the dial, the first virtual straight line passing through a center of the antenna electrode and the center of the dial in plan view.

In an electronic watch according to the present disclosure, as a solar cell arranged along the outer circumference of the antenna electrode, at least one solar cell may be arranged in addition to the first solar cell and the second solar cell.

In an electronic watch according to the present disclosure, a length dimension of outer edges of solar cells, which extend along the outer circumference of the antenna electrode, may be not more than a half of an outer circumferential length of the antenna, the solar cells being directly connected to each other and being arranged along the outer circumference of the antenna electrode.

In an electronic watch according to the present disclosure, a connection portion configured to connect the solar cells in series may be arranged at a position overlapping with any of an applied character, a simplified character, an applied ring, a dial ring, and a pointer shaft in plan view.

In an electronic watch according to the present disclosure, the solar panel may include an antenna cover portion overlapping with the antenna in plan view, and the antenna cover portion may have a signal passing part through which a signal to be received by the antenna passes.

In an electronic watch according to the present disclosure, on the solar panel, a difference in effective power generation area of a power generation layer between a solar cell including a power generation layer having a minimum effective power generation area and a solar cell including a power generation layer having a maximum effective power generation area may be equal to or smaller than a preset value.

In an electronic watch according to the present disclosure, the antenna may be a patch antenna.

DESCRIPTION OF EXEMPLARY EMBODIMENTS

First Exemplary Embodiment

Now, with reference to the drawings, description is made on an electronic watch 1 according to a first exemplary embodiment of the present disclosure. In the present exemplary embodiment, in the description, a surface of a cover glass 31 of the electronic watch 1 illustrated in FIG. 2 is referred to as a front side or an upper side, and a side of a case back 12 is referred to as a back side or a lower side.

The electronic watch 1 according to the present exemplary embodiment is configured so as to receive satellite signals from position information satellites, such as a plurality of GPS satellites that orbit Earth on predetermined courses and quasi-zenith satellites, acquire satellite time information, and correct internal time information. Further, as reception processing of the satellite signals, the electronic watch 1 performs automatic reception that starts reception automatically when predetermined conditions are satisfied in addition to manual reception that starts reception by a user operating a button.

Figure 1:
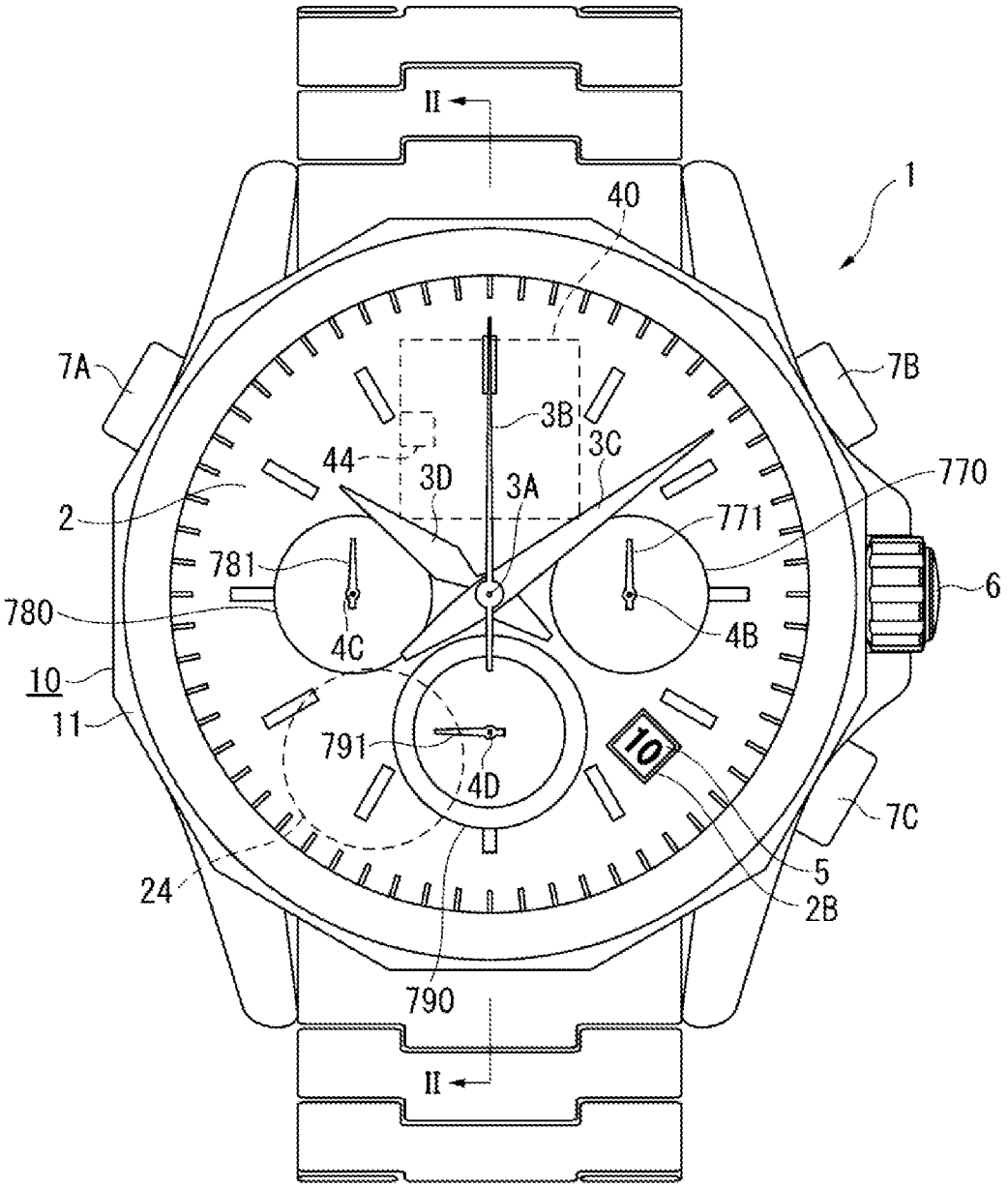
FIG. 1 is a front view illustrating an electronic watch according to a first exemplary embodiment.
Figure 2:
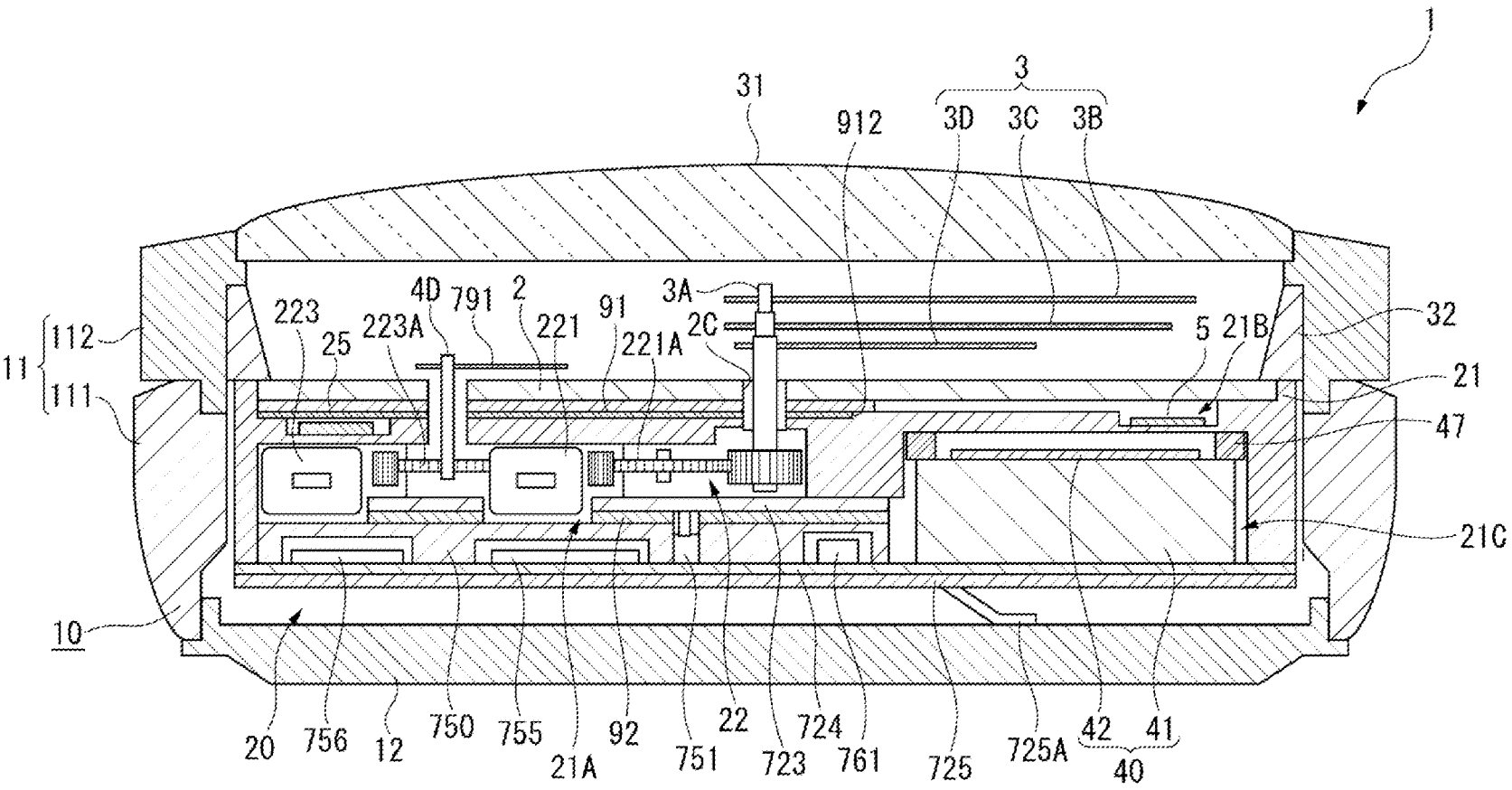
FIG. 2 is a sectional view taken along the line II-II in FIG. 1.

As illustrated in FIG. 1 and FIG. 2, the electronic watch 1 includes an outer case 10 configured to store a dial 2, a movement 20, a planar antenna 40, a secondary battery 24, and the like. Further, the electronic watch 1 includes a crown 6 and three buttons 7A, 7B, and 7C for external manipulation. Note that, FIG. 2 is a sectional view taken along a line connecting a position at six o'clock and a position at twelve o'clock on the dial 2 with each other.

The dial 2 is formed of a non-conductive member, such as polycarbonate, in a disk-like shape. A pointer shaft 3A is arranged at the plane center of the dial 2, and pointers 3, specifically, a second hand 3B, a minute hand 3C, and an hour hand 3D are mounted to the pointer shaft 3A.

The dial 2 has three small windows, namely, sub-dials. That is, as illustrated in FIG. 1, with respect to the plane center of the dial 2 at which the pointer shaft 3A is provided, a first small window 770 having a circular shape is provided in a direction pointing to three o'clock, a second small window 780 having a circular shape is provided in a direction pointing to nine o'clock, and a third small window 790 having a circular shape is provided in a direction pointing to six o'clock. A pointer shaft 4B is provided at the plane center of the first small window 770, and a pointer 771 is mounted to the pointer shaft 4B. A pointer shaft 4C is provided at the plane center of the second small window 780, and a pointer 781 is mounted to the pointer shaft 4C. A pointer shaft 4D is provided at the plane center of the third small window 790, and a pointer 791 is mounted to the pointer shaft 4D.

Further, with respect to the plane center of the dial 2, a date 2B having a rectangular shape is provided in a direction between indicators of four o'clock and five o'clock. As illustrated in FIG. 2, a date indicator 5 is arranged on the back side of the dial 2, the date indicator 5 is visually recognizable through the date window 2B. Further, a through hole 2C through which the pointer shaft 3A is inserted and through holes through which the pointer shafts of the pointers 771, 781, and 791 are inserted are formed in the dial 2.

In the present exemplary embodiment, the pointer 771 of the first small window 770 is a minute counting hand, the pointer 781 of the second small window 780 is a ⅕-second counting hand. The pointer 791 of the third small window 790 functions both as a mode hand and an hour counting hand. In a case where the pointer 791 is used as a mode hand, settings of modes, such as an off/on state of a setting of the daylight saving time, power indicator indicating a remaining capacity of the secondary battery 24, a flight mode, a time measurement mode in which GPS time information is received to correct an internal time, and a position measurement mode in which GPS time information and orbital information are received to correct an internal time and a time zone.

The second hand 3B, the minute hand 3C, the hour hand 3D, the pointers 771, 781, and 791, and the date indicator 5 are driven by stepping motors through intermediation of train wheels, which are described later.

External Configuration of Electronic Watch

As illustrated in FIG. 1 and FIG. 2, the outer case 10 includes a case body 11, the case back 12, and the cover glass 31. The case body 11 includes a case band 111 having a tubular shape and a bezel 112 provided on the front side of the case band 111.

On the back side of the case body 11, the case back 12 in a disk-like shape that closes an opening in the back side of the case body 11 is provided. The case back 12 is connected to the case band 111 of the case body 11 by a screwing structure. Note that, in the present exemplary embodiment, the case band 111 and the case back 12 are formed as independent members, but are not limited thereto. The case band 111 and the case back 12 may be integrated to be one piece.

A metal material such as stainless steel, titanium base alloy, aluminum, and brass is used for the case band 111, the bezel 112, and the case back 12.

Internal Configuration of Electronic Watch

Next, description is made on an internal configuration built in the outer case 10 of the electronic watch 1.

As illustrated in FIG. 2, the outer case 10 stores the movement 20, the planar antenna 40, the date indicator 5, a dial ring 32, and the like in addition to the dial 2.

The movement 20 includes a main plate 21, a train wheel bridge (omitted in illustration), a driver 22 supported by the main plate 21 and the train wheel bridge, a first circuit board 723, a second circuit board 724, a secondary battery 24, a solar panel 25, a first magnetic shield plate 91, and a second magnetic shield plate 92.

The main plate 21 is formed of a non-conductive member such as plastic. The main plate 21 has a driver storage portion 21A in which the driver 22 is stored, a date wheel arrangement portion 21B in which the date indicator 5 is arranged, and an antenna storage portion 21C in which the planar antenna 40 is stored.

The driver storage portion 21A and the antenna storage portion 21C are provided on the back side of the main plate 21. The plane position of the antenna storage portion 21C is at a position at twelve o'clock on the dial 2, and hence, as illustrated in FIG. 1, the planar antenna 40 is arranged at the position at twelve o'clock. Specifically, the planar antenna 40 is arranged between the pointer shaft 3A of the pointers 3 and the case body 11 in a range from an approximate position at eleven o'clock to an approximate position at one o'clock on the dial 2. That is, with respect to the plane center of the outer case 10, that is, the plane center of the dial 2, the center position of the planar antenna 40 is arranged within an angle range of sixty degrees between a direction pointing to eleven o'clock and a direction pointing to one o'clock.

Figure 3:
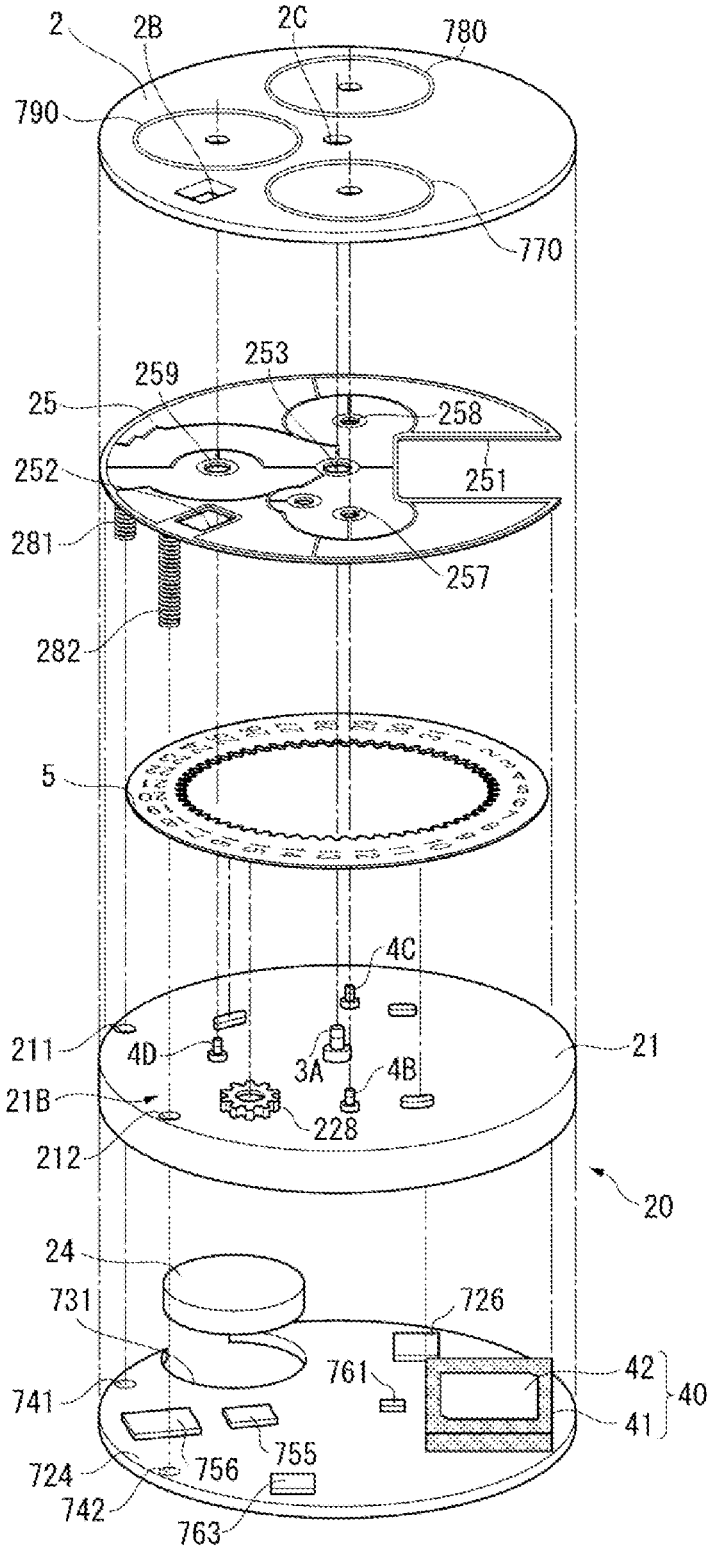
FIG. 3 is an exploded perspective view illustrating main parts of a movement of the electronic watch.

The driver 22 is stored in the driver storage portion 21A of the main plate 21, and includes a plurality of stepping motors and a plurality of train wheels that drive the second hand 3B, the minute hand 3C, the hour hand 3D, the pointers 771, 781, and 791, and the date indicator 5. For example, the driver 22 includes a first stepping motor 221 and a first train wheel 221A that drive the second hand 3B, a second stepping motor and a second train wheel (omitted in illustration) that drive the minute hand 3C and the hour hand 3D, and a third stepping motor 223 and a third train wheel 223A that are used for driving both the pointer 791 and the date indicator 5. As illustrated in FIG. 3, the third train wheel 223A includes a date indicator driving wheel 228 that rotates the date indicator 5.

Further, the driver 22 includes a fourth stepping motor and a fourth train wheel (omitted in illustration) that drive the pointer 771 and a fifth stepping motor and a fifth train wheel (omitted in illustration) that drive the pointer 781.

Although not illustrated, each of the first stepping motor 221 to the fifth stepping motor is arranged in a region prevented from overlapping with the planar antenna 40 in plan view seen from a direction vertical to the front surface of the dial 2. Further, as illustrated in FIG. 3, the pointer shaft 4B to which the pointer 771 is mounted, the pointer shaft 4C to which the pointer 781 is mounted, and the pointer shaft 4D to which the pointer 791 is mounted are arranged on an inner peripheral side of the date indicator 5.

A switching mechanism such as a winding stem and a setting lever (omitted in illustration), which is connected to the crown 6, is arranged at a portion of the movement 20 corresponding to a position at three o'clock on the dial 2 in plan view.

Magnetic Shield Plates

The first magnetic shield plate 91 and the second magnetic shield plate 92 are formed of a high permeability material such as pure iron, and are arranged at positions overlapping with the stepping motors in plan view so as to prevent malfunction of the stepping motors by causing an external magnetic field to circumvent the stepping motors. Each of the stepping motors includes a coil wound about a core, a stator, and a rotor. Of those, the coil portion is less liable to be affected by an external magnetic field, and hence the stepping motors are not necessarily required to overlap with the magnetic shield plates 91 and 92 in a planar manner. Thus, it is preferred that the magnetic shield plates 91 and 92 overlap with at least parts of the stepping motors in plan view, particularly, overlap with the stators and the rotors.

The first magnetic shield plate 91 is arranged on the cover glass 31 side of the main plate 21 and the date indicator 5 and the back side of the solar panel 25. The magnetic shield plate 91 is arranged so as to substantially cover the surfaces of the stepping motors on the dial 2 side.

In the first magnetic shield plate 91, an opening, which is formed at a position corresponding to the date window 2B so as to cause the date indicator 5 to be visually recognizable, and openings in which the pointer shafts 3A, 4B, 4C, and 4D are arranged are formed.

A region of the first magnetic shield plate 91, which overlaps with the planar antenna 40 in plan view, is cut out to obtain a cutout portion 912. Thus, the magnetic shield plate 91 is not arranged on the front side of the planar antenna 40, and the planar antenna 40 is capable of receiving a radio wave through the cutout portion 912 of the magnetic shield plate 91.

As illustrated in FIG. 2, the second magnetic shield plate 92 is arranged on the watch back side of the main plate 21, that is, the case back 12 side and on the watch front side with respect to the second circuit board 724. Specifically, the train wheel bridge (omitted in illustration) including bearings of the train wheels is arranged on the watch back side of the main plate 21, and the second magnetic shield plate 92 is arranged on the watch back side of the train wheel bridge. With this, the second magnetic shield plate 92 is arranged so as to substantially cover the back surfaces, namely, the surfaces of the stepping motors on the case back 12 side.

Circuit Boards

In the electronic watch 1 according to the present exemplary embodiment, two circuit boards including the first circuit board 723 for watch drive control and the second circuit board 724 for GPS reception are arranged.

The first circuit board 723 is arranged between the main plate 21 and the second magnetic shield plate 92, is provided with wiring lines conducted to the coils of the stepping motors, and is connected to the second circuit board 724 via a connector 751.

A watch control IC (omitted in illustration), a watch drive control IC (omitted in illustration), and the like, which receive a signal from the second circuit board 724 for reception and controls the motors, are mounted on the first circuit board 723. The second circuit board 724 is arranged on the back surface of the second magnetic shield plate 92 through a spacer 750. As illustrated also in FIG. 3, the second circuit board 724 is formed in a substantially circular shape in plan view, and a substantially circular cutout portion 731 in which the secondary battery 24 is arranged is formed. The secondary battery 24 is arranged in the cutout 731. With this, the electronic watch 1 can be reduced in thickness. On the front side of the second circuit board 724, the planar antenna 40, a reception unit 726 for processing satellite signals received from GPS satellites, a power source IC 755, a memory IC 756, a chip element 761, a crystal oscillator 763 are mounted. The memory IC 756 is formed of a flash memory, and stores a program of firmware for GPS reception and time zone data for determining a time zone based on position information calculated in measurement reception processing.

The spacer 750 protects the ICs and the like. In this case, it is preferred that the ICs be arranged at positions different from positions directly below at least the pointer shafts 3A, 4B, 4C, and 4D. As illustrated in FIG. 2, a circuit maintaining plate 725 is arranged on the back surface of the second circuit board 724.

Back case conduction springs 725A to be conducted to the case back 12 are integrally formed with the circuit maintaining plate 725. The back case conduction springs 725A are formed at a plurality of positions of the circuit maintaining plate 725.

Further, a battery terminal plate (omitted in illustration) is arranged on the back case side of the secondary battery 24, and the battery terminal plate is conducted to the second circuit board 724. Further, the solar panel 25 is conducted to the second circuit board 724 as described later, and it is configured that power generated at the solar panel 25 can be charged to the secondary battery 24 via the second circuit board 724.

Secondary Battery

As illustrated in FIG. 3, the secondary battery 24 is a button-type lithium ion battery formed in a circular shape in plan view, and supplies power to the driver 22, the reception unit 726, and the like. The secondary battery 24 is provided in the cutout 731 of the second circuit board 724, and is arranged at a position prevented from overlapping with the planar antenna 40, the reception unit 726, and the power source IC 755 in plan view, specifically, in a direction pointing to eight o'clock with respect to the plane center of the dial 2.

Date Wheel

The date indicator 5 being a calendar indicator formed in a ring shape on which a date is displayed on a surface thereof is arranged at the date wheel arrangement portion 21B of the main plate 21. The date indicator 5 is formed of a non-conductive member such as plastic. Here, the date indicator 5 overlaps with at least a part of the planar antenna 40 in plan view. Note that, the calendar indicator is not limited to the date indicator 5, and a day indicator for displaying a day, a month indicator for displaying a month, or the like may be adopted.

Dial

On the front side of the main plate 21, the dial 2 is arranged so as to cover the front side of the solar panel 25 and the date indicator 5. Thus, the solar panel 25 is arranged so as to overlap with the dial 2 in plan view seen from the direction vertical to the front surface of the dial 2. The dial 2 is formed of a material such as plastic, which is non-conductive and has translucency enabling at least part of light to pass through.

Here, applied characters, simplified characters, an applied ring, and the like may be provided on the front surface of the dial 2 that overlaps with the planar antenna 40 in plan view. In this case, in order to improve reception performance of the planar antenna 40, it is preferred that those parts be formed of a non-conductive member such as plastic instead of a metal material. In contrast, metal parts may be used for an applied ring, simplified characters, and the like on the third small window 790, which do not overlap with the planar antenna 40 in a planar manner.

Further, the dial 2 has translucency, and hence the solar panel 25 arranged on the back side of the dial 2 can be seen through when seen from the front side of the watch. Thus, the dial 2 is seen in different colors in a region in which the solar panel 25 is arranged and a region in which the solar panel 25 is not arranged. In order to make this color difference less noticeable, a designed tome may be added to the dial 2.

Further, a cutout 251 is formed in the solar panel 25, and hence a portion of the dial 2, which overlaps with the cutout 251, is seen to have a color tone different from that in other portions in some cases. In order to prevent this, a plastic sheet having the same color as the solar panel 25, for example, dark blue or purple, may be put under the solar panel 25. Alternatively, an entire part of the solar panel 25 is not cut out, but only a portion of the electrode layer for blocking a radio wave, which overlaps with the planar antenna 40 in a planar manner, is removed. A resin film layer being a base material is remained so as to match the color tone.

Dial Ring

On the front side of the dial 2, the dial ring 32 being a ring member, which is formed of a non-conductive synthetic resin, such as ABS resin, is provided. The dial ring 32 is arranged along a periphery of the dial 2, and has an inner circumferential surface being an inclined surface. On the inclined surface, hour characters and indicators for a time difference of world time are printed. When the dial ring 32 is formed of plastic, reception performance can be secured, and a complex shape can be formed to improve design.

Planar Antenna

The planar antenna 40 is arranged in the antenna storage portion 21C of the main plate 21. The planar antenna 40 is formed of a patch antenna that is also referred to as a microstrip antenna, and receives satellite signals from GPS satellites.

The planar antenna 40 does not overlap with the case body 11, the solar panel 25, and the magnetic shield plates 91 and 92 in plan view, and overlaps with the date indicator 5, the dial 2, and the cover glass 31 that are formed of non-conductive members. That is, on the watch front side of the planar antenna 40 in the electronic watch 1, all the components that overlap with the planar antenna 40 in plan view are formed of non-conductive members.

Thus, a satellite signal transmitted from the watch front side passes through the cover glass 31, passes through the dial 2, the date indicator 5, and the main plate 21 without being blocked by the case body 11, the magnetic shield plates 91 and 92, and the solar panel 25, and is received by the planar antenna 40. Note that, areas in which the second hand 3B, the minute hand 3C, and the hour hand 3D overlap with the planar antenna 40 are small, and hence reception of the satellite signal is not interfered even when the hands are formed of metal. However, it is more preferred that the hands be made of non-conductive members from a viewpoint of avoiding influence caused by blocking the satellite signal.

A GPS satellite transmits a satellite signal that is clockwise rotation round polarized. Thus, the planar antenna 40 in the present exemplary embodiment is formed of a patch antenna excellent in a circular polarization property.

Figure 4:
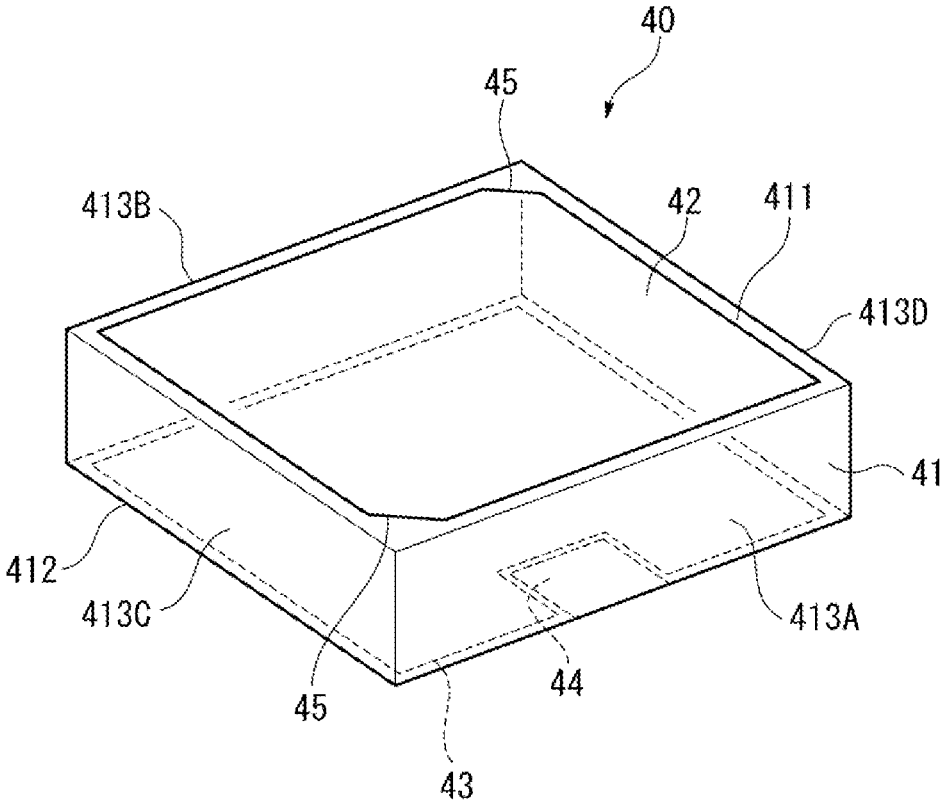
FIG. 4 is a perspective view illustrating a planar antenna embedded in the electronic watch.

As illustrated in FIG. 4, the planar antenna 40 is a surface-mounting type patch antenna including a dielectric base material 41 on which an antenna electrode 42, a GND electrode 43, and a power supply electrode 44 are laminated.

The dielectric base material 41 is formed of a dielectric body such as ceramics, in a rectangular parallelepiped shape. Here, A surface of the dielectric base material 41 on the main plate 21 side and the dial 2 side is referred to as a front surface 411, and a surface on the second circuit board 724 side is referred to as a back surface 412. Further, four side surfaces of the dielectric base material 41 are referred to as a first side surface 413A, a second side surface 413B, a third side surface 413C, and a fourth side surface 413D, respectively. As illustrated in FIG. 4, the first side surface 413A and the second side surface 413B are arranged so as to face each other, and the third side surface 413C and the fourth side surface 413D are arranged so as to face each other.

The antenna electrode 42 is laminated on the front surface 411 of the dielectric base material 41, is formed in a rectangular shape in plan view, and has degeneration separation element portions 45 formed at one pair of diagonal portions in order to receive a circularly polarized wave. The degeneration separation element portions 45 shifts a balance between two orthogonal polarized waves generated at the antenna electrode 42, and are only required to be cutouts, protruding portions, or the like. In the present exemplary embodiment, the degeneration separation element portions 45 are formed by cutting the corner portions of the antenna electrode 42.

The power supply electrode 44 is formed by subdividing the GND electrode 43 on the back surface 412 of the dielectric base material 41. The power supply electrode 44 is capacitively coupled to the antenna electrode 42 at the center of the first side surface 413A. A satellite radio wave received by the antenna electrode 42 is transmitted to the power supply electrode 44 via the capacity coupling, and can be extracted from the power supply electrode 44. Therefore, the planar antenna 40 is a patch antenna adopting an electromagnetic coupling system.

The GND electrode 43 is insulated from the power supply electrode 44 on the back surface 412 of the dielectric base material 41, and is a solid electrode that covers portions other than the power supply electrode 44.

Figure 5:
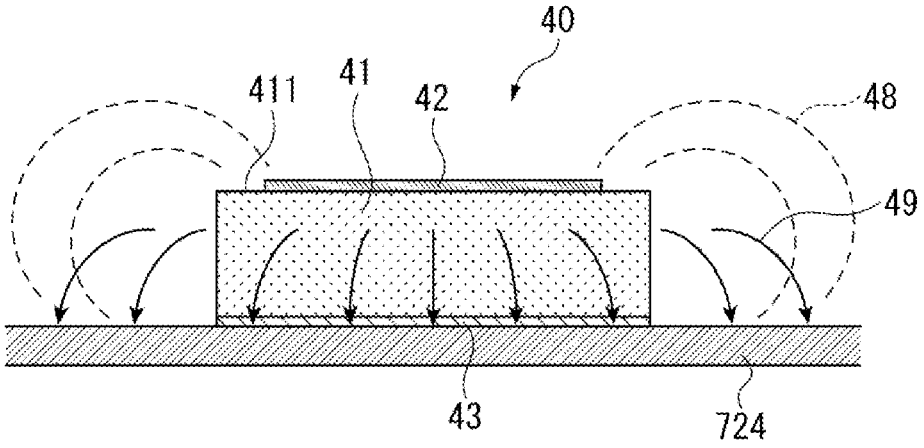
FIG. 5 is a diagram illustrating a principle of the planar antenna.

FIG. 5 is a diagram illustrating a principle of the planar antenna 40. Note that, in FIG. 5, dotted lines 48 indicate radio waves received by the planar antenna 40, and arrows 49 indicate electric force lines.

In a case where the patch antenna is in a rectangular shape, one side resonates in a half wavelength. In a case where the patch antenna is in a circular shape, a diameter resonates in approximately 0.58 wavelength. When a dielectric is used, size reduction can be achieved due to a wavelength shortening effect. In an operation principle of the patch antenna, a strong electric field along an edge of a patch, that is, the antenna electrode 42 is radiated to a space. Thus, the electric force lines in the vicinity of the antenna is stronger, and are liable to be affected by a metal part or a dielectric in the vicinity. In view of this, during GPS reception, the metallic outer case 10 and the antenna electrode 42 be separated from each other by a certain distance.

The planar antenna 40 can be manufactured in the following manner. First, barium titanate having a relative dielectric constant of approximately from 60 to 120 is used as a main raw material, is formed in a target shape by a press machine, and then is subjected to firing. In this manner, ceramics to form the dielectric base material 41 of the antenna is obtained. The GND electrode 43 to be a ground electrode of the antenna is formed on the back surface 412 of the dielectric base material 41 by, for example, performing screen printing mainly with a paste material such as silver (Ag).

The antenna electrode 42, which determines a frequency of the antenna and a polarized wave of a signal to be received, is formed on the front surface 411 of the dielectric base material 41 in a manner similar to the case of the GND electrode 43. The antenna electrode 42 is formed to be slightly smaller than the front surface of the dielectric base material 41, and an exposed surface on which the antenna electrode 42 is not laminated and the dielectric base material 41 is exposed is provided in the periphery of the antenna electrode 42 on the front surface of the dielectric base material 41.

On the back surface 412 of the dielectric base material 41, the power supply electrode 44 is formed in a manner similar to the case of the GND electrode 43.

The dielectric base material 41 has a front surface formed in a substantially square shape. A dimension of one side is approximately 11 mm, and a thickness dimension is 3 mm. The antenna electrode 42 has a front surface formed in a substantially square shape, and a dimension of one side is approximately from 8 mm to 9 mm.

In a case where a direction with respect to the plane center of the planar antenna 40 corresponds to a direction of the indicators with respect to the center of the dial 2, the power supply electrode 44 of the planar antenna 40 is arranged at a position in a direction pointing to nine o'clock as illustrated in FIG. 1. Thus, the planar antenna 40 obtains an orientation in a direction pointing to three o'clock or nine o'clock in consideration of clockwise rotation polarization.

Assumed that automatic reception processing is executed under a state in which a user walks with the electronic watch 1 being mounted. In a case where the user walks with the electronic watch 1 mounted on a left wrist, a direction pointing to nine o'clock on the electronic watch 1 is substantially the zenith direction. In a case where the user walks with the electronic watch 1 mounted on a right wrist, a direction pointing to three o'clock is substantially the zenith direction. Therefore, as in the case of the planar antenna 40 in the present exemplary embodiment, a satellite signal from the zenith direction is easily received when the orientation in a direction pointing to three o'clock or nine o'clock is adopted.

The planar antenna 40 is mounted on the front surface of the second circuit board 724, and is electrically connected to the reception unit 726, which is mounted on the second circuit board 724, via a power supply line. The GND electrode 43 of the planar antenna 40 is conducted to a ground portion of the reception unit 726 via a ground pattern of the second circuit board 724, and the second circuit board 724 functions as a ground plane. Further, the ground portion of the reception unit 726 is conducted to the case band 111 and the case back 12, which are metallic, via the ground pattern of the second circuit board 724, and hence the case band 111 and the case back 12 can be utilized as ground planes.

As illustrated in FIG. 2, the planar antenna 40 is arranged in the antenna storage portion 21C by fixing the second circuit board 724 to the main plate 21. The dielectric base material 41 of the planar antenna 40 is formed of ceramics, which is hard and liable to be chip, and hence a buffer material 47 such as sponge is interposed between the dielectric base material 41 and the main plate 21. Thus, the dielectric base material 41 is prevented from colliding against the main plate 21 and being damaged.

Solar Panel

The solar panel 25 is formed by forming a metal electrode (omitted in illustration) on a base 26 formed of a resin film and further laminating a semiconductor layer, a transparent electrode, and a protective layer (omitted in illustration) subsequently on the base 26.

Figure 6:
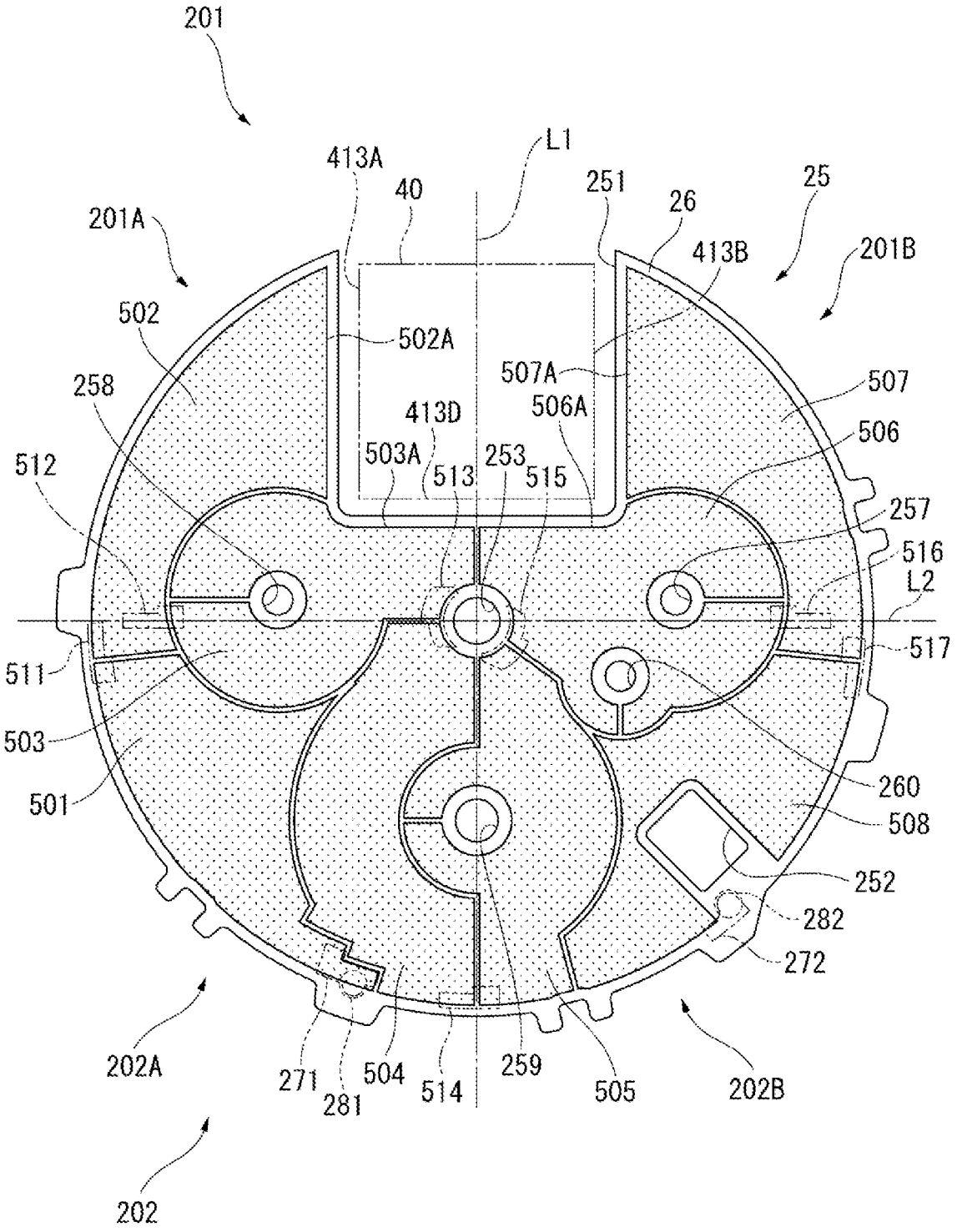
FIG. 6 is a plan view illustrating a solar panel in the first exemplary embodiment.

A frequency of a GPS satellite signal is approximately 1.5 GHz, which is a high frequency, and hence a radio wave is attenuated even with a thin transparent electrode of the solar panel 25 unlike a normal radio wave with a long wavelength that is received by a radio wave watch. As a result, an antenna property is degraded. Thus, as illustrated in FIG. 3 and FIG. 6, the cutout 251 is formed in the portion of the solar panel 25 formed in a disk-like shape, the portion overlapping with the planar antenna 40 in plan view. The solar panel 25 is arranged on the front side of the main plate 21, and is not arranged on the front side of the planar antenna 40. Therefore, the planar antenna 40 is capable of receiving a radio wave through the cutout 251 of the solar panel 25.

Note that, an opening 252 that overlaps with the date window 2B of the dial 2 in a planar manner and holes 253 and 257 to 260 through which the pointer shafts 3A and 4B to 4D inserted are formed in the solar panel 25. Note that, in the electronic watch 1 according to in the present exemplary embodiment, a pointer shaft is not arranged in the hole 260. However, a pointer shaft is provided in the hole 260 in some cases depending on a specification of the electronic watch 1. For example, in a case where an hour hand and a minute hand that indicate an hour and a minute of a home time are provided in the third small window 790, an AM/PM pointer for displaying morning (AM) and afternoon (PM) of a home time is mounted to a pointer shaft arranged in the hole 260 in some cases. Thus, the hole 260 is formed in the solar panel 25 in advance, and a dial in which a hole corresponding to the hole 260 is formed and a dial in which a hole corresponding to the hole 260 is not formed are used for different purposes.

The solar panel 25 is divided into a plurality of solar cells, and the solar cells are connected in series. As illustrated in FIG. 6, the solar panel 25 in the present exemplary embodiment includes eight solar cells that are a solar cell 501 to a solar cell 508, and the solar cells 501 to 508 are connected in series. An electromotive voltage of each solar cell is approximately 0.6V or higher. Thus, when the eight solar cells 501 to 508 are connected in series, an electromotive voltage of approximately 4.8V or higher, which is obtained by approximately 0.6V×8, is obtained. Therefore, the secondary battery 24 formed of lithium ion with a high electromotive voltage can be charged, and a device such as a GPS reception device with a large consumption current can be embedded. Note that, the number of solar cells is not limited to eight, and may be seven or less or nine or more. However, when the number of cells is small, an electromotive voltage is lowered. Thus, a booster circuit is required to be provided separately. Meanwhile, when the number of cells is large, an effective power generation area of each cell is reduced, which lowers a power generation current. Therefore, it is preferred that the number of cells be about eight.

In the following, description is made on arrangement of the solar cell 501 to the solar cell 508. Note that, in the description of arrangement, indicator positions from one o'clock to twelve o'clock provided along the outer circumference of the dial 2 are referred to as a position at one o'clock to a position at twelve o'clock.

The solar cell 501 is arranged in a region from an approximate position at seven o'clock to an approximate position at nine o'clock along the outer circumference of the solar panel 25.

The solar cell 502 is arranged next to the solar cell 501, and is arranged in a region from an approximate position at nine o'clock to an approximate position at eleven o'clock along the outer circumference of the solar panel 25.

The solar cell 503 is arranged on an inner circumference side of the solar cell 501 and the solar cell 502, that is, on the hole 253 side formed substantially at a position of the plane center of the solar panel 25.

The solar cell 504 is arranged next to the solar cell 501 and the solar cell 503. The solar cell 504 is arranged on the hole 259 with respect to the solar cell 501, and is arranged on a side of an approximate position at six o'clock with respect to the solar cell 503.

The solar cell 505 is arranged next to the solar cell 504. The solar cell 505 is arranged on the opening 252 side with respect to the solar cell 504.

The solar cell 506 is arranged next to the solar cell 503 and the solar cell 505. The solar cell 506 is arranged on a side of a position at three o'clock with respect to the solar cell 503, and is arranged on a side of a position at two o'clock with respect to the solar cell 505.

The solar cell 507 is arranged next to the solar cell 506, and is arranged in a region from an approximate position at one o'clock to an approximate position at three o'clock along the outer circumference of the solar panel 25.

The solar cell 508 are arranged next to the solar cell 505, the solar cell 506, and the solar cell 507, and is arranged in a region from an approximate position at three o'clock to an approximate position at five o'clock along the outer circumference of the solar panel 25.

An outer edge of the solar cell 501, which extends along an outer circumference of the solar panel 25, is formed in an arc shape, a division part between the solar cell 501 and the solar cell 502 is formed linearly, and a division part between the solar cell 501 and the solar cell 503 is formed in an arc shape along the outer circumference of the second small window 780. A division part between the solar cell 501 and the solar cell 504 is formed in a substantially arc shape, and a side on the outer circumference of the solar panel 25 is formed to be bent in a zigzag manner.

An outer edge of the solar cell 502, which extends along the outer circumference of the solar panel 25, is formed in an arc shape. The division part between the solar cell 501 and the solar cell 502 is formed linearly, and a division part between the solar cell 502 and the solar cell 503 is formed in an arc shape along the outer circumference of the second small window 780. An outer edge 502A of the solar cell 502, which extends along the cutout 251, is formed linearly so as to be substantially parallel with a cutout surface of the cutout 251 on a side at nine o'clock, that is, the first side surface 413A.

A division part between the solar cell 503, and the solar cell 501 and the solar cell 502 is formed in an arc shape along the second small window 780. An outer edge 503A of the solar cell 503, which extends along the cutout 251, is formed linearly so as to be substantially parallel with a cutout surface of the cutout 251 on a side at six o'clock, that is, the fourth side surface 413D. A division part between the solar cell 503 and the solar cell 506 is formed to extend linearly from the hole 253 to a position at twelve o'clock, and a part of a division part between the solar cell 503 and the solar cell 504 is formed to extend linearly from the hole 253 to a position at nine o'clock.

A division part between the solar cell 504, and the solar cell 501 and the solar cell 503 is formed along outer edges of the solar cell 501 and the solar cell 503. A division part between the solar cell 504 and the solar cell 505 is formed from the hole 253 to a position at six o'clock, and has a linear part and a semi-circular part.

A division part between the solar cell 505 and the solar cell 504 is formed along an outer edge of the solar cell 504. A division part between the solar cell 505 and the solar cell 506 is formed to extend linearly from the hole 253 to an approximate position at four o'clock, and is further formed to be bent. A division part between the solar cell 505 and the solar cell 508 is formed in an arc shape along the outer circumference of the third small window 790, and is further formed linearly toward the outer circumference of the solar panel 25.

An outer edge 506A of the solar cell 506, which extends along the cutout 251, is formed linearly so as to be substantially parallel with the cutout surface of the cutout 251 on the side at six o'clock, that is, the fourth side surface 413D. A division between the solar cell 506 and the solar cell 503 is formed along the solar cell 503. A division part between the solar cell 506 and the solar cell 507 is formed in an arc shape along the outer circumference of the first small window 770. A division part between the solar cell 506 and the solar cell 508 is formed along the outer circumference of the first small window 770. Further, the division part between the solar cell 506 and the solar cell 508 is formed along the outer circumference of a small window in a case where a pointer shaft is arranged in the hole 260 and the small window adjacent to the first small window 770 is formed as a variation of the dial 2.

An outer edge of the solar cell 507 is formed in an arc shape along the outer circumference of the solar panel 25. A division part between the solar cell 507 and the solar cell 508 is formed linearly, and a division part between the solar cell 507 and the solar cell 506 is formed in an arc shape along the outer circumference of the second small window 780. An outer edge 507A of the solar cell 507, which extends along the cutout 251, is formed linearly so as to be substantially parallel with the cutout surface of the cutout 251 on a side at three o'clock, that is, the second side surface 413B.

An outer edge of the solar cell 508, which extends along the outer circumference of the solar panel 25, is formed in an arc shape except for a portion corresponding to the opening 252, and the portion corresponding to the opening 252 is formed along the opening 252. A division part between the solar cell 508, and the solar cell 505 and the solar cell 506 is formed along outer edges of the solar cell 505 and the solar cell 506.

Note that, the outer edges of the solar cell 503, the solar cell 504, the solar cell 505, and the solar cell 506, which extend along the outer circumference of the hole 253, are formed in an arc shape along the outer circumference of the hole 253. Further, the portions of the solar cell 503, the solar cell 505, and the solar cell 506 in the peripheries of the holes 257, 258, and 259 through which the pointer shafts 4B, 4C, and 4D are inserted and the hole 260 are formed concentrically with the holes 257, 258, 259, and 260, respectively.

Here, a circumferential length of each of the first side surface 413A of the planar antenna 40, the outer edge 502A of the solar cell 502 arranged along the second side surface 413B, and the outer edge 507A of the solar cell 507, that is, a length of each of the outer edges 502A and 507A, more specifically, each dimension in a direction along a first virtual straight line L1 in FIG. 6 is substantially the same as the length of the first side surface 413A and the second side surface 413B of the planar antenna 40, that is, a dimension in the direction along the first virtual straight line L1. Note that, the first virtual straight line L1 is a virtual straight line passing through the center of the antenna electrode 42 and the center of the dial 2. A second virtual straight line L2 is a virtual straight line being orthogonal to the first virtual straight line L1 and passing through the center of the dial 2. Further, a circumferential length of each of the outer edge 503A of the solar cell 503, which is arranged along the fourth side surface 413D of the planar antenna 40, and the outer edge 506A of the solar cell 506, that is, a length of each of the outer edges 503A and 506A, more specifically, each dimension in a direction along the second virtual straight line L2 in FIG. 6 is substantially a half of a length of the fourth side surface 413D of the planar antenna 40, that is, a dimension in a direction along the second virtual straight line L2.

Therefore, a length of the circumferences of the solar cell 502 and the solar cell 503 that are connected in series, which extend along the outer circumference of the antenna electrode 42, that is, a dimension obtained by summing up all the circumferential lengths of the outer edge 502A and the outer edge 503A, and a length of the circumferences of the solar cell 506 and the solar cell 507 that are connected in series, which extend along the outer circumference of the antenna electrode 42, that is, a dimension obtained by summing up all the circumferential lengths of the outer edge 506A and the outer edge 507A are the same, and are not more than a half of a dimension of the outer circumferential length of the planar antenna 40, that is, a dimension obtained by summing up all the circumferential lengths of the four side surfaces 413A, 413B, 413C, and 413D. For example, when it is assumed that a circumferential length of each of the side surfaces 413A, 413B, 413C, and 413D of the planar antenna 40 is approximately 10 mm, the outer circumferential length of the planar antenna 40 is approximately 40 mm, a length dimension, that is, an outer edge length obtained by summing up all the circumferential lengths of the outer edge 502A and the outer edge 503A is approximately 15 mm, and a dimension, that is, an outer edge length obtained by summing up all the circumferential lengths of the outer edge 506A and the outer edge 507A is also approximately 15 mm. Therefore, the length dimension of the outer edge being approximately 15 mm is not more than a half of the outer circumferential length of the planar antenna 40 being approximately 40 mm.

Further, the power generation layers of the solar cells 501 to 508 are designed so as to have substantially even effective power generation areas, that is, so that variation in effective power generation area falls within a certain range. Here, the expression that variation in effective power generation area falls within a certain range indicates that a difference between effective power generation areas of the power generation layers of a solar cell, which has the smallest effective power generation area of the power generation layer, and a solar cell, which has the largest effective power generation area of the power generation layer, among the solar cells 501 to 508 provided on the solar panel 25 is equal to or smaller than a preset value. Specifically, the expression indicates that an effective area of the power generation layer of each of the solar cells is not more than 10% of a value x where an average value of the effective power generation areas of the solar cells is set to x. The same is applied in other exemplary embodiments described below.

The solar cells 501 to 508 are designed to be arranged substantially symmetrical across the first virtual straight line L1 in FIG. 6. For example, the solar cell 502 and the solar cell 507 are designed symmetrical across the first virtual straight line L1.

Comparing the solar cell 503 and the solar cell 506, the hole 260 is formed only in the solar cell 506, which reduces an effective power generation area of the power generation layer of the solar cell 506. Thus, the solar cell 506 has an extended portion formed in the periphery of the hole 260 to increase the effective power generation area of the power generation layer.

Comparing the solar cell 501 and the solar cell 508, the opening 252 is formed only in the solar cell 508, which reduces an effective power generation area of the power generation layer of the solar cell 508. Thus, a division line between the solar cell 508 and the solar cell 505 is set closer to the first virtual straight line L1 than a division line between the solar cell 501 and the solar cell 504, which increases the effective power generation area of the power generation layer of the solar cell 508.

The division line between the solar cell 508 and the solar cell 505 is set closer to the first virtual straight line L1 than the division line between the solar cell 501 and the solar cell 504, which reduces an effective power generation area of the power generation layer of the solar cell 505 when comparing the solar cell 504 and the solar cell 505. Thus, the division line in the periphery of the hole 259 is formed to extend to the solar cell 504 side, which increases the effective power generation are of the power generation layer of the solar cell 505.

By setting the shapes of the power generation layers of the solar cells 501 to 508 as described above, the power generation layers of the solar cells 501 to 508 are designed so that variation in effective power generation area of the power generation layers falls within a certain range.

Next, description is made on a charge route of the secondary battery 24 with the solar cells 501 to 508.

Electrode terminals 271 and 272 are provided on the outer circumferential end of the solar panel 25, and the solar cells 501 to 508 are connected in series between the electrode terminals 271 and 272.

The electrode terminal 271 is conducted to one electrode of the metal electrode and the transparent electrode of the solar cell 501, and the electrode terminal 272 is conducted to another electrode of the metal electrode and the transparent electrode of the solar cell 508. Further, as illustrated in FIG. 3, a first conduction spring 281 being a first conductive member and a second conduction spring 282 being a second conductive member are arranged between the electrode terminals 271 and 272 and charge terminals 741 and 742 of the second circuit board 724. Therefore, an electric current generated by the solar panel 25 is charged into the secondary battery 24 via the electrode terminals 271 and 272, the conduction springs 281 and 282, and the charge terminals 741 and 742.

Note that, the electrode terminals 271 and 272 and the conduction springs 281 and 282 are arranged on the outer circumferential side of the date indicator 5 in plan view, and are covered with the dial ring 32 being a parting member. Through holes 211 and 212 through which the conduction springs 281 and 282 are inserted are formed in the main plate 21.

The solar cells 501 to 508 are connected in series in such manner that a metal electrode of one solar cell and a transparent electrode of another solar cell of the adjacent solar cells are connected with each of connection portions 511 to 517.

The connection portion 511 electrically connects the solar cell 501 and the solar cell 502 in series, that is, brings the cells in a conduction state. The connection portion 512 electrically connects the solar cell 502 and the solar cell 503 in series, that is, brings the cells in a conduction state. The connection portion 513 electrically connects the solar cell 503 and the solar cell 504 in series, that is, brings the cells in a conduction state. The connection portion 514 electrically connects the solar cell 504 and the solar cell 505 in series, that is, brings the cells in a conduction state. The connection portion 515 electrically connects the solar cell 505 and the solar cell 506 in series, that is, brings the cells in a conduction state. The connection portion 516 electrically connects the solar cell 506 and the solar cell 507 in series, that is, brings the cells in a conduction state. The connection portion 517 electrically connects the solar cell 507 and the solar cell 508 in series, that is, brings the cells in a conduction state.

Of the four solar cells 502, 503, 506, and 507 arranged along the outer circumference of the antenna electrode 42 of the planar antenna 40, the solar cell 502 and the solar cell 503, and the solar cell 506 and the solar cell 507 are directly connected to each other with the connection portions 512 and 516.

The solar cell 503 and the solar cell 506 are continuously arranged along the fourth side surface 413D of the planar antenna 40, that is, along the outer circumference of the antenna electrode 42. The solar cell 503 and the solar cell 506 are not directly connected to each other, and are connected in series via the solar cell 504 and the solar cell 505 that are not arranged along the outer circumference of the antenna electrode 42.

That is, the solar cell 504 and the solar cell 505 are arranged so that the solar cell 503 and the solar cell 506 between the outer circumference of the antenna electrode 42, and the solar cell 504 and the solar cell 505, which forms a third solar cell. Therefore, the solar cell 503 and the solar cell 506 connected in series via the solar cell 504 and the solar cell 505 being the third solar cell form a first solar cell and a second solar cell.

The connection portions 511, 514, and 517 are provided along the outer circumferences of the solar cells 501, 502, 504, 505, 507, and 508, and are arranged at positions overlapping with the dial ring 32 in plan view. Thus, the connection portions 511, 514, and 517 are arranged so as to be less noticeable when the dial 2 having translucency is visually recognized.

The connection portions 512 and 516 are arranged at positions overlapping with simplified characters indicating nine o'clock and three o'clock, namely, bar-shaped indicators on the dial 2 in plan view. Thus, the connection portions 512 and 516 are arranged so as to be less noticeable when the dial 2 is visually recognized.

The connection portions 513 and 515 are arranged along the periphery of the hole 253 through which the pointer shaft 3A is inserted. Thus, the connection portions 513 and 515 are arranged at positions overlapping with the pointers 3, which perform hand operation, in plan view, and are arranged so as to be less noticeable when the dial 2 is visually recognized.

The second circuit board 724 is arranged so as to overlap with the dial 2 in plan view. The first conduction spring 281 and the second conduction spring 282 are arranged at positions away from the planar antenna 40 in plan view. As illustrated in FIG. 6, in plan view, in a case where the dial 2 is divided into two regions 201 and 202 with the second virtual straight line L2, the first conduction spring 281 and the second conduction spring 282 are arranged in the region 202 different from the region 201 in which the planar antenna 40 is arranged. Here, the region 201 is a region including a position at twelve o'clock on the dial 2, and specifically, a semi-circular region from a position at nine o'clock to a position at three o'clock with a position twelve o'clock therebetween. The region 202 is a region including a position at six o'clock on the dial 2, and specifically, a semi-circular region from a position at three o'clock to a position at nine o'clock with a position six o'clock therebetween.

In a case where the region 201 is divided into two regions 201A and 201B with the first virtual straight line L1, the region 201A is a quadrant region from a position at nine o'clock to a position at twelve o'clock, and the region 201B is a quadrant region from a position at twelve o'clock to a position at three o'clock. Similarly, in a case where the region 202 is divided into two regions 202A and 202B with the first virtual straight line L1, the region 202A is a quadrant region from a position at six o'clock to a position at nine o'clock, and the region 202B is a quadrant region from a position at three o'clock to a position at six o'clock.

The electrode terminal 271 and the first conduction spring 281 are arranged in the region 202A, and the electrode terminal 272 and the second conduction spring 282 are arranged in the region 202B. That is, the first conduction spring 281 and the second conduction spring 282 are connection members that connect the solar panel 25 and the second circuit board 724. The conduction springs 281 and 282 are arranged at the positions away from the planar antenna 40, in plan view, and further the conduction springs 281 and 282 are arranged away from each other.

Advantageous Effects of First Exemplary Embodiment

In the electronic watch 1, the solar cell 503 and the solar cell 506 arranged along the antenna electrode 42 of the planar antenna 40 are not directly connected, but are connected via the solar cell 504 and the solar cell 505. Thus, an electric current, which interferes a radio wave received by the planar antenna 40, can be prevented from flowing to the solar cell 503 and the solar cell 506 in the periphery of the planar antenna 40, and degradation of reception performance of the planar antenna 40 can be suppressed.

Further, of the two regions obtained by division with the second virtual straight line L2, the planar antenna 40 can be arranged in the one region 201, and the first conduction spring 281 and the second conduction spring 282 can be arranged in the other region 202. Thus, the planar antenna 40, and the first conduction spring 281 and the second conduction spring 282 can be arranged away from each other. Thus, influence caused by the first conduction spring 281, and the second conduction spring 282 can be suppressed to improve reception sensitivity of the planar antenna 40.

Moreover, a layout in which the solar cell 504 and the solar cell 505 are arranged between the solar cell 501 and the solar cell 508. Thus, the first conduction spring 281 and the second conduction spring 282 can be arranged away from each other to a certain extent, and hence the planar antenna 40 can be less affected by the first conduction spring 281 and the second conduction spring 282.

The four solar cells including the solar cell 502, the solar cell 503, the solar cell 506, and the solar cell 507 are arranged along the antenna electrode 42 of the planar antenna 40. Thus, an electric current, which interferes a radio wave received by the planar antenna 40, can further be prevented from flowing to the solar cells 502, 503, 506, and 507 in the periphery of the planar antenna 40, and degradation of reception performance of the planar antenna 40 can be suppressed.

The inventors of the present disclosure conducted the following tests. That is, one solar cell was arranged along the first side surface 413A, the fourth side surface 413D, and the second side surface 413B of the planar antenna 40, that is, along the outer circumference of the antenna electrode 42, and an antenna gain in such case was set as a reference. A gain difference between the reference antenna gain and an antenna gain in a case where two solar cells are arranged along the outer circumference of the antenna electrode 42 is approximately 0.9 dBic. A gain difference between the reference antenna gain and an antenna gain in a case where four solar cells are arranged along the outer circumference of the antenna electrode 42 as in the first exemplary embodiment is approximately 1.3 dBic. That is, even when the solar cell 502 and the solar cell 503 are directly connected and the solar cell 506 and the solar cell 507 are directly connected, reception performance can be improved more in a case where the four solar cells 502, 503, 506, and 507 are arranged along the outer circumference of the antenna electrode 42 than in a case where two solar cells are arranged. Therefore, reception performance can be improved more in a case where three or more solar cells are arranged along the outer circumference of the antenna electrode 42 than in a case where two or less solar cells are arranged.

Among the four solar cells 502, 503, 506, and 507 arranged along the outer circumference of the antenna electrode 42, a length dimension of each of the outer edges 502A and 503A of the solar cell 502 and the solar cell 503 that are directly connected to each other is not more than a half of the outer circumferential length of the planar antenna 40. A length dimension of each of the outer edges 506A and 507A of the solar cell 506 and the solar cell 507 that are directly connected to each other is also not more than a half of the outer circumferential length of the planar antenna 40. Thus, reception performance of the planar antenna 40 is less affected by the solar panel 25. That is, reception performance of the planar antenna 40 is affected by the solar cells, which are arranged along the outer circumference of the antenna electrode 42 and directly connected. Particularly, when the length dimension of the outer edges of the solar cells to be directly connected, which extend along the outer circumference of the antenna electrode 42, is larger than a half of the outer circumferential length of the planar antenna 40, reception performance of the planar antenna 40 is more liable to be affected. In contrast, in the present exemplary embodiment, the length dimension of the outer edges of the solar cells to be directly connected, which extend along the outer circumference of the antenna electrode 42, is set not to be more than a half of the outer circumferential length of the planar antenna 40, and hence reception performance of the planar antenna 40 can be less affected by the solar panel 25.

An amount of power generated by the solar panel 25 is determined by a cell having the smallest effective power generation area of the power generation layer among the solar cells 501 to 508 connected in series. Thus, when the power generation layers of the solar cells 501 to 508 have even effective power generation areas, the amount of the generated power can be maximized. In the present exemplary embodiment, by devising the shapes of the power generation layers of the solar cells 501 to 508 as described above, the power generation layers of the solar cells 501 to 508 are designed so that variation in effective power generation area of the power generation layers falls within a certain range. Thus, the amount of the power generated by the solar panel 25 can be increased.

The connection portions 511 to 518 that connect the solar cells 501 to 508 in series are arranged at the positions overlapping with the dial ring 32, the simplified characters, the applied ring, and the pointers in plan view. Thus, the connection portions 511 to 518 can be less noticeable when the dial 2 is visually recognized. Thus, an appearance of the electronic watch 1 can be improved.

The portion of the solar panel 25, which overlaps with the planar antenna 40 in plan view, is cut out to be the cutout 251, and the solar panel 25 is not arranged on the upper surface of the planar antenna 40. Thus, a satellite signal is not blocked by the solar panel 25, and degradation of reception performance of the planar antenna 40 can be suppressed.

The power supply electrode 44 of the planar antenna 40 is arranged in a direction pointing to nine o'clock with respect to the center of the planar antenna 40 in plan view. Thus, when a clockwise rotation polarized signal such as a GPS satellite signal is received, the orientation of the planar antenna 40 in a plane direction can be set in a direction pointing to three o'clock or nine o'clock. Therefore, when a user walks with the electronic watch 1 mounted on a wrist, a direction pointing to three o'clock or nine o'clock of the electronic watch 1 can be oriented in the zenith direction. Thus, a satellite signal transmitted from a position information satellite can be received at high sensitivity.

Therefore, particularly, probability of succeeding reception during automatic reception can be improved, and an internal time can be corrected automatically. As a result, accuracy of a displayed time can be improved, and the electronic watch 1 achieving high functionality can be provided.

The power supply electrode 44 of the planar antenna 40 is arranged in a direction pointing to nine o'clock. Thus, the direction pointing to nine o'clock in the electronic watch 1 can be oriented to the zenith direction when an arm is lowered in a vertical direction. Therefore, even when an arm swings frontward and rearward during walk, change in reception variation can be reduced, and probability of succeeding automatic reception can further be improved.

The planar antenna 40 is arranged in a direction pointing to twelve o'clock from the center of the dial 2, and the power supply electrode 44 is arranged in a direction pointing to nine o'clock from the center of the planar antenna 40. Thus, the power supply electrode 44 can be arranged away from the outer case 10.

Thus, the planar antenna 40 can be less affected by the metallic case body 11, and reception sensitivity of the planar antenna 40 can be improved.

The power supply electrode 44 of the planar antenna 40 is formed of a strip electrode. Thus, the planar antenna 40 can be reduced in thickness as compared to the power supply portion using a power supply pin, and can be manufactured easily with surface mounting.

Second Exemplary Embodiment

Figure 7:
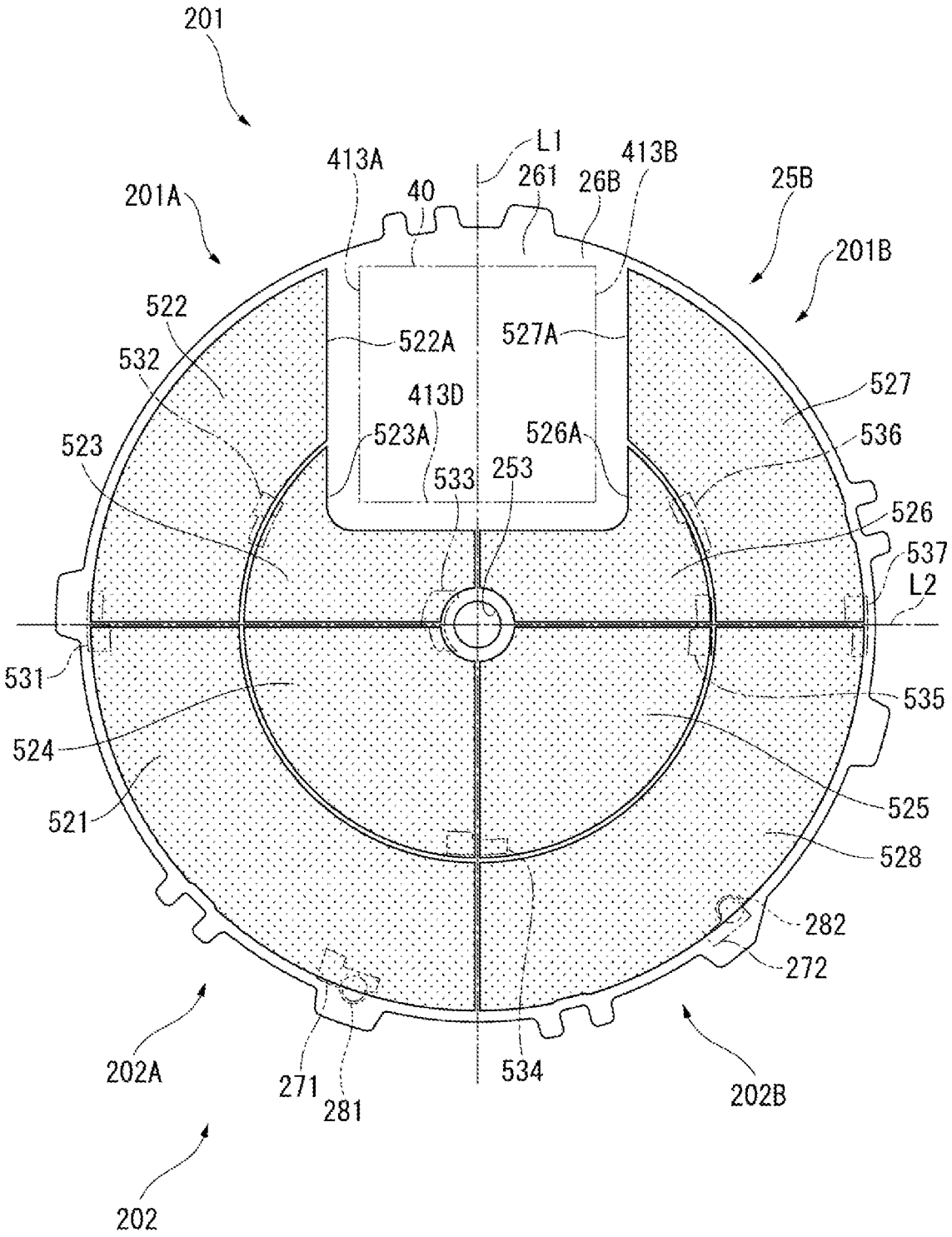
FIG. 7 is a plan view illustrating a solar panel in a second exemplary embodiment.

Next, with reference to FIG. 7, description is made on a solar panel 25B in a second exemplary embodiment. The solar panel 25B is provided to a general watch, which does not include a sub-dial and includes an hour hand, a minute hand, and a second hand that are mounted to a pointer shaft provided at a center of a dial (omitted in illustration) in plan view. Note that, components of the second exemplary embodiment that are identical or similar to the corresponding components of the first exemplary embodiment are denoted by identical reference signs and that description for these components is omitted.

A base 26B of the solar panel 25B according to the second exemplary embodiment is not cut out in a portion overlapping with the planar antenna 40 in plan view, and the base 26B is formed in a substantially circular shape in plan view. A solar cell is not arranged in a region of the base 26B, which overlaps with the planar antenna 40 in plan view, and hence the base 26B does not interfere reception of a satellite signal. An antenna cover portion 261 is formed in a region of the base 26B, which does not include a solar cell and covers the planar antenna 40. Further, the entire antenna cover potion 261 allows a satellite signal to pass therethrough, and hence the entire antenna cover potion 261 also functions as a signal passing part.

The hole 253 through which the pointer shaft is inserted is formed in the solar panel 25B.

Eight solar cells including a solar cell 521 to a solar cell 528 connected in series are provided on the base 26B.

The solar cell 521 is arranged in a region from a position at six o'clock to a position at nine o'clock along the outer circumference of the solar panel 25B.

The solar cell 522 is arranged next to the solar cell 521, and is arranged in a region from a position at nine o'clock to an approximate position at eleven o'clock along the outer circumference of the solar panel 25B.

The solar cell 523 is arranged on the inner circumferential side of the solar cell 522, that is, on the hole 253 side formed substantially at a position of the plane center of the solar panel 25B.

The solar cell 524 is arranged on the inner circumferential side of the solar cell 521.

The solar cell 525 is arranged next to the solar cell 524.

The solar cell 526 is arranged next to the solar cell 523 and the solar cell 525.

The solar cell 527 is arranged on the outer circumferential side of the solar cell 526, and is arranged in a region from an approximate position at one o'clock to a position at three o'clock along the outer circumference of the solar panel 25B.

The solar cell 528 is arranged on the outer circumferential side of the solar cell 525, and is arranged in a region from a position at three o'clock to a position at six o'clock along the outer circumference of the solar panel 25B.

That is, the solar cells 521 to 528 are divided along the first virtual straight line L1 and the second virtual straight line L2, and each of the solar cells is further divided into two sections on the inner circumferential side and the outer circumferential side along a circumferential division line. Therefore, the solar cell 523, the solar cell 524, the solar cell 525, and the solar cell 526, which are arranged on the inner circumferential side of the solar panel 25B, are formed substantially in a pie shape, and the solar cell 521, the solar cell 522, the solar cell 527, and the solar cell 528 which are arranged on the outer circumference side of the solar panel 25B, are formed substantially in an annular fan shape.

Further, the solar cell 522, the solar cell 523, the solar cell 526, and the solar cell 527, which are arranged on a side of twelve o'clock with respect to the second virtual straight line L2 on the solar panel 25B are not provided in a region overlapping with the planar antenna 40 in plan view.

Thus, the solar cells 521 to 528 are in a symmetrical shape across the first virtual straight line L1.

Further, the solar cells 522 and 527 are not provided in portions overlapping with the planar antenna 40 in plan view, and hence have effective power generation areas smaller than those of the solar cells 521 and 528. Similarly, the solar cells 523 and 526 are not provided in portions overlapping with the planar antenna 40 in plan view, and hence have effective power generation areas smaller than those of the solar cells 524 and 525.

The circumferential division line that divides the four solar cells 523, 524, 525, and 526 on the inner circumferential side from the four solar cells 521, 522, 527, and 528 on the outer circumferential side is set so that variation in effective power generation area of the solar cells 521 to 528 falls within a certain range.

An outer edge 522A of the solar cell 522, which extends along the planar antenna 40, is formed linearly so as to be substantially parallel with the first side surface 413A.

An outer edge 523A of the solar cell 523, which extends along the planar antenna 40, is formed so as to have a linear part substantially parallel with the first side surface 413A, a linear part substantially parallel with the fourth side surface 413D, and a curved part connecting the linear parts with each other.

An outer edge 526A of the solar cell 526, which extends along the planar antenna 40, is formed to have a linear part substantially parallel with the second side surface 413B, a linear part substantially parallel with the fourth side surface 413D, and a curved part connecting the linear parts with each other.

An outer edge of 527A of the solar cell 527, which extends along the planar antenna 40, is formed linearly so as to be substantially parallel with the second side surface 413B.

Thus, a length of the circumferences of the solar cell 522 and the solar cell 523 that are connected in series, which extend along the outer circumference of the antenna electrode 42, that is, a dimension obtained by summing up all the circumferential lengths of the outer edge 522A and the outer edge 523A, and a length of the circumferences of the solar cell 526 and the solar cell 527 that are connected in series, which extend along the outer circumference of the antenna electrode 42, that is, a dimension obtained by summing up all the circumferential lengths of the outer edge 526A and the outer edge 527A are the same dimension, and are not more than a half of the outer circumferential length of the planar antenna 40.

Next, description is made on a charge route of the secondary battery 24 with the solar cells 521 to 528.

Similarly to the solar panel 25, the electrode terminals 271 and 272 are provided on the outer circumferential end of the solar panel 25B, and the solar cells 521 to 528 are connected in series between the electrode terminals 271 and 272.

The electrode terminal 271 is conducted to one electrode of the metal electrode and the transparent electrode of the solar cell 521, and the electrode terminal 272 is conducted to another electrode of the metal electrode and the transparent electrode of the solar cell 528. Further, similarly in the first exemplary embodiment, the electrode terminals 271 and 272 are conducted to the secondary battery 24 via the first conduction spring 281, the second conduction spring 282, and the second circuit board 724.

Similarly in the first exemplary embodiment, the solar cells 521 to 528 are connected in series with connection portions 531 to 537.

The connection portion 531 electrically connects the solar cell 521 and the solar cell 522 in series. The connection portion 532 electrically connects the solar cell 522 and the solar cell 523 in series. the connection portion 533 electrically connects the solar cell 523 and the solar cell 524 in series. the connection portion 534 electrically connects the solar cell 524 and the solar cell 525 in series. the connection portion 535 electrically connects the solar cell 525 and the solar cell 526 in series. the connection portion 536 electrically connects the solar cell 526 and the solar cell 527 in series. the connection portion 537 electrically connects the solar cell 527 and the solar cell 528 in series.

Of the four solar cell 522, 523, 526, and 527, which are arranged along the outer circumference of the antenna electrode 42 of the planar antenna 40, the solar cell 522 and the solar cell 523, and the solar cell 526 and the solar cell 527 are directly connected to each other with the connection portions 532 and 536.

The solar cell 523 and the solar cell 526, which are arranged along the fourth side surface 413D of the planar antenna 40, are not directly connected to each other, and are connected in series via the solar cell 524 and the solar cell 525, which are not arranged along the outer circumference of the antenna electrode 42. Therefore, similarly in the first exemplary embodiment, the solar cell 523 and the solar cell 526 form a first solar cell and a second solar cell, and the solar cell 524 and the solar cell 525 form a third solar cell.

The connection portions 531 and 537 are provided along the outer circumference of the solar panel 25B, and are arranged at positions overlapping with the dial ring 32 in plan view.

Thus, the connection portions 531 and 537 are arranged so as to be less noticeable when the dial 2 having translucency is visually recognized.

The connection portions 532, 534, and 536 are arranged in directions pointing to ten o'clock, six o'clock, and two o'clock, respectively, with respect to the center of the dial 2 in plan view, that is, the hole 253. Thus, by being arranged so as to overlap with simplified characters indicating time, namely, bar-shaped indicators in plan view, the connection portion 532, 534, and 536 are can be arranged so as to be less recognizable when the dial 2 is visually recognized.

The connection portion 533 is arranged at a position overlapping the periphery of the hole 253 through which the pointer shaft 3A is inserted, that is, the pointers 3, which perform hand operation, in plan view, and is arranged so as to be less noticeable when the dial 2 is visually recognized.

In a case where the solar panel 25B is divided into the four regions 201A, 201B, 202A, and 202B with the first virtual straight line L1 and the second virtual straight line L2 similarly to the first exemplary embodiment, the electrode terminal 271 and the first conduction spring 281 are arranged in the region 202A, and the electrode terminal 272 and the second conduction spring 282 are arranged in the region 202B similarly in the first exemplary embodiment.

The second exemplary embodiment as described above can also exert effects similar to those in the first exemplary embodiment.

Further, on the solar panel 25B, the solar cells 521 to 528 are in a shape symmetrical across the first virtual straight line L1. Thus, particularly in a case of an electronic watch including a pointer shaft provided only at the plane center of the dial 2, balance in a layout of the solar cells 521 to 528 can be improved.

Third Exemplary Embodiment

Figure 8:
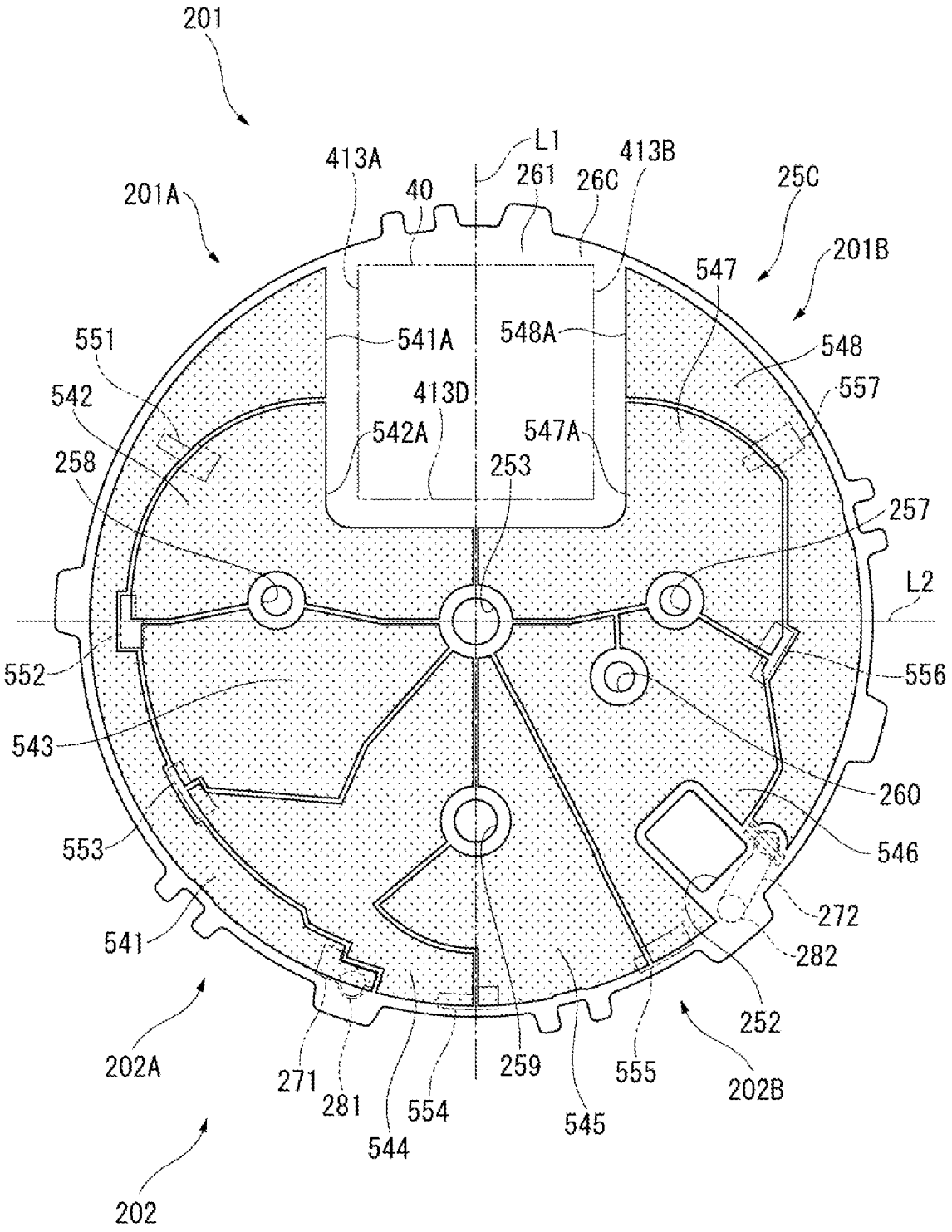
FIG. 8 is a plan view illustrating a solar panel in a third exemplary embodiment.

Next, with reference to FIG. 8, description is made on a solar panel 25C in a third exemplary embodiment. The solar panel 25C is provided to a watch including the sub-dial similar in the electronic watch 1 according to the first exemplary embodiment. Thus, similarly to the solar panel 25, the holes 253, 257, 258, 259, and 260 through which the pointer shafts are inserted are formed in the solar panel 25C. Note that, components of the third exemplary embodiment that are identical or similar to the corresponding components of the first exemplary embodiment are denoted by identical reference signs and that description for these components is omitted.

Similarly to the base 26B in the second exemplary embodiment, a portion of a base 26C of the solar panel 25C in the third exemplary embodiment, which does not overlap with the planar antenna 40 in plan view, is not cut out, and the antenna cover potion 261 that covers the planar antenna 40 is formed. Also on the base 26C, the entire antenna cover potion 261 also functions as a signal passing part.

Eight solar cells including a solar cell 541 to a solar cell 548 connected in series are provided on the base 26C. On the solar panel 25C, four solar cells including the solar cell 541, the solar cell 542, the solar cell 547, and the solar cell 548 are arranged along the outer circumference of the planar antenna 40. Further, the solar cell 541 is conducted to the electrode terminal 271 and the first conduction spring 281, and the solar cell 548 is conducted to the electrode terminal 272 and the second conduction spring 282. That is, the solar cell 541 and the solar cell 548, which are conducted to the second circuit board 724, are provided along the antenna electrode 42 of the planar antenna 40, which is different from the first and second exemplary embodiments.

Thus, the solar cell 541 and the solar cell 548 are arranged along the outer circumference of the solar panel 25C from the regions 202A and 202B in which the electrode terminals 271 and 272 are arranged to the region 201A and the region 201B in which the planar antenna 40 is arranged. Further, the solar cell 542 to the solar cell 547 are arranged in the periphery of the hole 253.

The solar cell 541 is arranged in a region from an approximate position at seven o'clock to an approximate position at eleven o'clock along the outer circumference of the solar panel 25C.

The solar cell 542 is arranged on the inner circumferential side of the solar cell 541, and is arranged in a region from an approximate position at nine o'clock to an approximate position at eleven o'clock along the inner circumference of the solar cell 541.

The solar cell 543 is arranged on the inner circumferential side of the solar cell 541, and is arranged in a region from an approximate position at eight o'clock to an approximate position at nine o'clock along the inner circumference of the solar cell 541.

The solar cell 544 is arranged in a region from a position at six o'clock on the outer circumference of the solar panel 25C to an approximate position at eight o'clock along the inner circumference of the solar cell 541.

The solar cell 545 is arranged in a region from an approximate position at five o'clock to a position at six o'clock on the solar panel 25C.

The solar cell 546 is arranged in a region from an approximate position at five o'clock to an approximate position at three o'clock along the inner circumference of the solar cell 548 on the solar panel 25C.

The solar cell 547 is arranged on the inner circumferential side of the solar cell 548, and is arranged in a region from an approximate position at three o'clock to an approximate position at one o'clock along the inner circumference of the solar cell 548.

The solar cell 548 is arranged in a region from an approximate position at one o'clock to an approximate position at four o'clock along the outer circumference of the solar panel 25C.

The solar cells 541 to 548 are set so that variation in effective power generation area falls within a certain range. Further, a part of the division lines of the solar cell 541 to 548 is set so as to overlap with the applied ring of the sub-dial in plan view.

An outer edge 541A of the solar cell 541, which extends along the planar antenna 40, is formed linearly so as to be substantially parallel with the first side surface 413A.

An outer edge 542A of the solar cell 542, which extends along the planar antenna 40, is formed so as to have a linear part substantially parallel with the first side surface 413A, a linear part substantially parallel with the fourth side surface 413D, and a curved part connecting the linear parts with each other.

An outer edge 547A of the solar cell 547, which extends along the planar antenna 40, is formed to have a linear part substantially parallel with the second side surface 413B, a linear part substantially parallel with the fourth side surface 413D, and a curved part connecting the linear parts with each other.

An outer edge of 548A of the solar cell 548, which extends along the planar antenna 40, is formed linearly so as to be substantially parallel with the second side surface 413B.

Thus, a length of the circumferences of the solar cell 541 and the solar cell 542 that are connected in series, which extend along the outer circumference of the antenna electrode 42, that is, a dimension obtained by summing up all the circumferential lengths of the outer edge 541A and the outer edge 542A, and a length of the circumferences of the solar cell 547 and the solar cell 548 that are connected in series, which extend along the outer circumference of the antenna electrode 42, that is, a dimension obtained by summing up all the circumferential lengths of the outer edge 547A and the outer edge 548A are the same dimension, and are not more than a half of the outer circumferential length of the planar antenna 40.

Next, description is made on a charge route of the secondary battery 24 with the solar cells 541 to 548.

Similarly to the solar panel 25, the electrode terminals 271 and 272 are provided on the outer circumferential end of the solar panel 25C, and the solar cells 541 to 548 are connected in series between the electrode terminals 271 and 272.

The electrode terminal 271 is conducted to one electrode of the metal electrode and the transparent electrode of the solar cell 541, and the electrode terminal 272 is conducted to another electrode of the metal electrode and the transparent electrode of the solar cell 548. Further, similarly in the first exemplary embodiment, the electrode terminals 271 and 272 are conducted to the secondary battery 24 via the first conduction spring 281, the second conduction spring 282, and the second circuit board 724.

Similarly to the first exemplary embodiment, the solar cells 541 to 548 are connected in series with connection portions 551 to 557.

The connection portion 551 electrically connects the solar cell 541 and the solar cell 542 in series. The connection portion 552 electrically connects the solar cell 542 and the solar cell 543 in series. The connection portion 553 electrically connects the solar cell 543 and the solar cell 544 in series. The connection portion 554 electrically connects the solar cell 544 and the solar cell 545 in series. The connection portion 555 electrically connects the solar cell 545 and the solar cell 546 in series. The connection portion 556 electrically connects the solar cell 546 and the solar cell 547 in series. The connection portion 557 electrically connects the solar cell 547 and the solar cell 548 in series.

Of the four solar cells 541, 542, 547, and 548, which are arranged along the outer circumference of the antenna electrode 42 of the planar antenna 40, the solar cell 541 and the solar cell 522, and the solar cell 527 and the solar cell 548 are directly connected to each other with the connection portions 551 and 557.

The solar cell 542 and the solar cell 547, which are arranged along the fourth side surface 413D of the planar antenna 40, are not directly connected to each other, and are connected in series via the solar cell 543, the solar cell 544, the solar cell 545, and the solar cell 546, which are not arranged along the outer circumference of the antenna electrode 42. Therefore, the solar cell 542 and the solar cell 547 form a first solar cell and a second solar cell, and the solar cell 543, 544, 545, and 546 form a third solar cell.

The connection portions 554 and 555 are provided along the outer circumference of the solar panel 25C, and are arranged at positions overlapping with the dial ring 32 in plan view.

The connection portions 551, 552, 553, 556, and 557 are arranged so as to overlap with the simplified characters indicating time and the applied ring of the sub-dial in plan view.

Therefore, the connection portions 551 to 557 are arranged so as to be less noticeable when the dial 2 is visually recognized.

In a case where the solar panel 25C is divided into the four regions 201A, 201B, 202A, and 202B with the first virtual straight line L1 and the second virtual straight line L2 similarly in, the first exemplary embodiment, the electrode terminal 271 and the first conduction spring 281 are arranged in the region 202A, and the electrode terminal 272 and the second conduction spring 282 are arranged in the region 202B similarly in the first exemplary embodiment.

The third exemplary embodiment as described above can also exert effects similar to those in the first exemplary embodiment.

Further, on the solar panel 25C, the solar cell 541 and the solar cell 548 extend to the positions along the outer circumference of the planar antenna 40, and the solar cell 542 and the solar cell 547 are connected in series via the four solar cells 543 to 546. Thus, a current that interferes reception by the planar antenna 40 is less liable to flow, and reception performance of the planar antenna 40 can be improved.

Fourth Exemplary Embodiment

Figure 9:
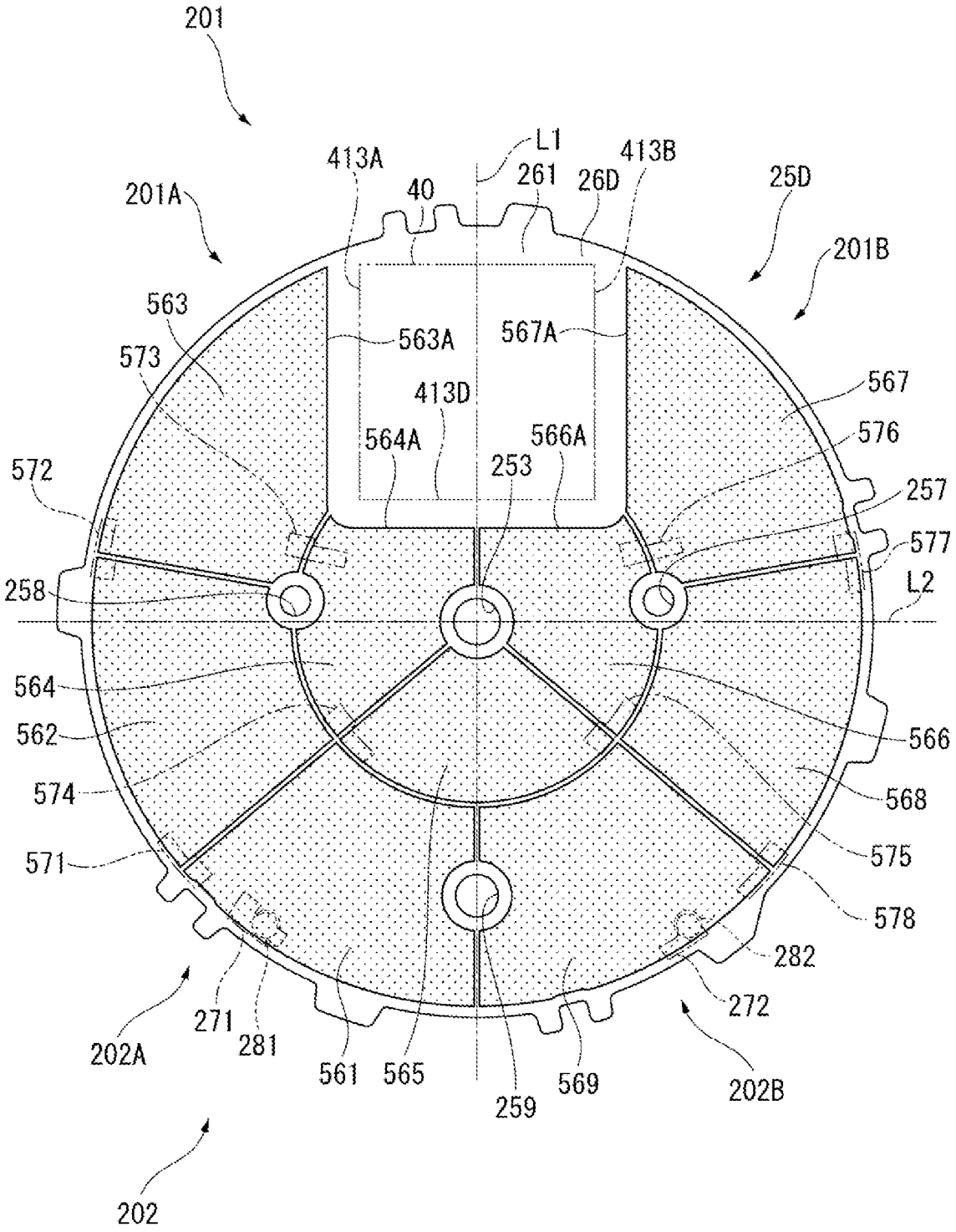
FIG. 9 is a plan view illustrating a solar panel in a fourth exemplary embodiment.

Next, with reference to FIG. 9, description is made on a solar panel 25D in a fourth exemplary embodiment. The solar panel 25D is provided to a watch including the sub-dial similar in the electronic watch 1 according to the first exemplary embodiment. Thus, similarly to the solar panel 25, the holes 253, 257, 258, and 259 through which the pointer shafts are inserted are formed in the solar panel 25D. Note that, components of the fourth exemplary embodiment that are identical or similar to the corresponding components of the first exemplary embodiment are denoted by identical reference signs and that description for these components is omitted.

Similarly to the base 26C in the third exemplary embodiment, a portion of a base 26D of the solar panel 25D in the fourth exemplary embodiment, which does not overlap with the planar antenna 40 in plan view, is not cut out, and the antenna cover potion 261 that covers the planar antenna 40 is formed. Also on the base 26D, the entire antenna cover potion 261 also functions as a signal passing part.

Nine solar cells including a solar cell 561 to a solar cell 569 connected in series are provided on the base 26D. The six solar cells including the solar cell 561, the solar cell 562, the solar cell 563, the solar cell 567, the solar cell 568, and the solar cell 569 are arranged along the outer circumference of the solar panel 25D, and the three solar cells including the solar cell 564, the solar cell 565, and the solar cell 566 are arranged on the inner circumferential side of those solar cells.

Here, the solar cells 561 to 563 and 567 to 569, which are arranged on the outer circumferential side of the solar panel 25D, are formed substantially in an annular fan shape with division lines provided radially from the center of the solar panel 25D and a division line provided in an arc shape with the center of the solar panel 25D as the center point. Here, the solar cells 564 to 566, which are arranged on the inner circumferential side of the solar panel 25D, are formed substantially in a pie shape with the division lines provided radially from the center of the solar panel 25D and the division line provided in an arc shape with the center of the solar panel 25D as the center point. However, the solar cells 563, 564, 566, and 567 have a planer shape prevented from being provided in a region overlapping with the planar antenna 40 in plan view.

The solar cell 561 is arranged in a region from a position at six o'clock to an approximate position in the middle between seven o'clock and eight o'clock along the outer circumference of the solar panel 25D.

The solar cell 562 is arranged in a region from an approximate position in the middle between seven o'clock and eight o'clock to an approximate position in the middle between nine o'clock and ten o'clock along the outer circumference of the solar panel 25D.

The solar cell 563 is arranged in a region from an approximate position in the middle between nine o'clock and ten o'clock to an approximate position at eleven o'clock along the outer circumference of the solar panel 25D.

The solar cell 564 is arranged on the inner circumferential side of the solar cells 562 and 563.

The solar cell 565 is arranged on the inner circumferential side of the solar cells 561 and 569.

The solar cell 566 is arranged on the inner circumferential side of the solar cells 567 and 568.

The solar cell 567 is arranged in a region from an approximate position at one o'clock to an approximate position in the middle between two o'clock and three o'clock along the outer circumference of the solar panel 25D.

The solar cell 568 is arranged in a region from an approximate position in the middle between two o'clock and three o'clock to an approximate position in the middle between four o'clock and five o'clock along the outer circumference of the solar panel 25D.

The solar cell 569 is arranged in a region from an approximate position in the middle between four o'clock and five o'clock to a position at six o'clock along the outer circumference of the solar panel 25D.

The solar cells 561 to 569 are set so that variation in effective power generation area falls within a certain range.

An outer edge 563A of the solar cell 563, which extends along the planar antenna 40, is formed linearly so as to be substantially parallel with the first side surface 413A.

Outer edges 564A and 566A of the solar cell 564 and the solar cell 566, which extend along the planar antenna 40, are formed linearly so as to be substantially parallel with the fourth side surface 413D.

An outer edge of 567A of the solar cell 567, which extends along the planar antenna 40, is formed linearly so as to be substantially parallel with the second side surface 413B.

Thus, a length of the circumferences of the solar cell 563 and the solar cell 564 that are connected in series, which extend along the outer circumference of the antenna electrode 42, that is, a dimension obtained by summing up all the circumferential lengths of the outer edge 563A and the outer edge 564A, and a length of the circumferences of the solar cell 566 and the solar cell 567 that are connected in series, which extend along the outer circumference of the antenna electrode 42, that is, a dimension obtained by summing up all the circumferential lengths of the outer edge 566A and the outer edge 567A are the same dimension, and are not more than a half of the outer circumferential length of the planar antenna 40.

Next, description is made on a charge route of the secondary battery 24 with the solar cells 561 to 568.

Similarly to the solar panel 25, the electrode terminals 271 and 272 are provided on the outer circumferential end of the solar panel 25D, and the solar cells 561 to 569 are connected in series between the electrode terminals 271 and 272.

The electrode terminal 271 is conducted to one electrode of the metal electrode and the transparent electrode of the solar cell 561, and the electrode terminal 272 is conducted to another electrode of the metal electrode and the transparent electrode of the solar cell 569. Further, similarly in the first exemplary embodiment, the electrode terminals 271 and 272 are conducted to the secondary battery 24 via the first conduction spring 281, the second conduction spring 282, and the second circuit board 724.

Similarly to the first exemplary embodiment, the solar cells 561 to 569 are connected in series with connection portions 571 to 578.

The connection portion 571 electrically connects the solar cell 561 and the solar cell 562 in series. The connection portion 572 electrically connects the solar cell 562 and the solar cell 563 in series. The connection portion 573 electrically connects the solar cell 563 and the solar cell 564 in series. The connection portion 574 electrically connects the solar cell 564 and the solar cell 565 in series. The connection portion 575 electrically connects the solar cell 565 and the solar cell 566 in series. The connection portion 576 electrically connects the solar cell 566 and the solar cell 567 in series. The connection portion 577 electrically connects the solar cell 567 and the solar cell 568 in series. The connection portion 578 electrically connects the solar cell 568 and the solar cell 569 in series.

Of the four solar cell 563, 564, 566, and 567, which are arranged along the outer circumference of the antenna electrode 42 of the planar antenna 40, the solar cell 563 and the solar cell 564, and the solar cell 566 and the solar cell 567 are directly connected to each other with the connection portions 573 and 576.

The solar cell 564 and the solar cell 566 are not directly connected to each other, and are connected in series via the solar cell 565 that is not arranged along the outer circumference of the antenna electrode 42. Therefore, the solar cell 564 and the solar cell 566 form a first solar cell and a second solar cell, and the solar cell 565 forms a third solar cell.

The connection portions 571, 572, 577, and 578 are provided along the outer circumference of the solar panel 25D, and are arranged at positions overlapping with the dial ring 32 in plan view.

The connection portions 573 and 576 are arranged at positions, which overlap with the pointer shafts inserted through the holes 257 and 258, in plan view.

The connection portions 574 and 575 are arranged so as to overlap with the applied ring of the sub-dial in plan view.

Therefore, the connection portions 571 to 578 are arranged so as to be less noticeable when the dial 2 is visually recognized.

In a case where the solar panel 25D is divided into the four regions 201A, 201B, 202A, and 202B with the first virtual straight line L1 and the second virtual straight line L2 similarly to the first exemplary embodiment, the electrode terminal 271 and the first conduction spring 281 are arranged in the region 202A, and the electrode terminal 272 and the second conduction spring 282 are arranged in the region 202B similarly in the first exemplary embodiment.

The fourth exemplary embodiment as described above can also exert effects similar to those in the first exemplary embodiment.

Further, on the solar panel 25D, the nine solar cells 561 to 569 are connected in series. Thus, a power generation voltage can be higher than the voltage in a case of the solar panels 25, 25B, and 25C in the exemplary embodiments in which the eight solar cells are connected in series.

Fifth Exemplary Embodiment

Figure 10:
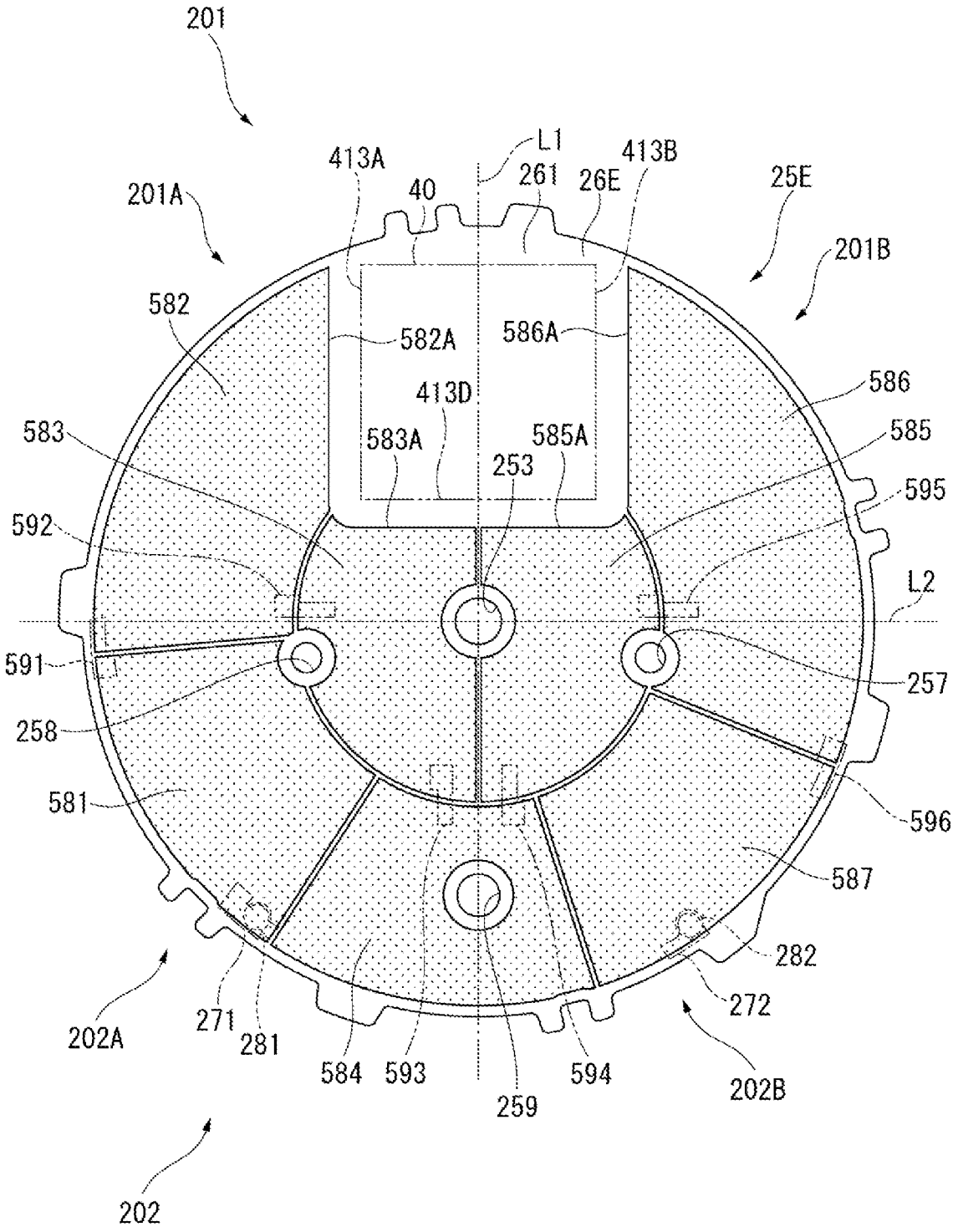
FIG. 10 is a plan view illustrating a solar panel in a fifth exemplary embodiment.

Next, with reference to FIG. 10, description is made on a solar panel 25E in a fifth exemplary embodiment. The solar panel 25E is provided to a watch including the sub-dial similar in the electronic watch 1 according to the first exemplary embodiment. Thus, similarly to the solar panel 25, the holes 253, 257, 258, and 259 through which the pointer shafts are inserted are provided in the solar panel 25E. Note that, components of the fifth exemplary embodiment that are identical or similar to the corresponding components of the first exemplary embodiment are denoted by identical reference signs and that description for these components is omitted.

Similarly to the base 26C in the third exemplary embodiment, a portion of a base 26E of the solar panel 25E in the fifth exemplary embodiment, which does not overlap with the planar antenna 40 in plan view, is not cut out, and the antenna cover potion 261 that covers the planar antenna 40 is formed. Also on the base 26E, the entire antenna cover potion 261 also functions as a signal passing part.

Seven solar cells including a solar cell 581 to a solar cell 587 connected in series are provided on the base 26E. The five solar cells including the solar cell 581, the solar cell 582, the solar cell 584, the solar cell 586, and the solar cell 587 are arranged along the outer circumference of the solar panel 25E, and the two solar cells including the solar cell 583 and the solar cell 585 are arranged on the inner circumferential side of those solar cells.

Here, the solar cells 581, 582, 584, 586, and 587, which are arranged on the outer circumferential side of the solar panel 25E, are formed substantially in an annular fan shape with division lines provided radially from the center of the solar panel 25E and a division line provided in an arc shape with the center of the solar panel 25E as the center. Here, the solar cells 583 and 585, which are arranged on the outer circumferential side of the solar panel 25E, are formed substantially in an annular fan shape with division lines provided along the first virtual straight line L1 and a division line provided in an arc shape with the center of the solar panel 25E as the center. However, the solar cells 582, 583, 585, and 586 have a planer shape prevented from being provided in a region overlapping with the planar antenna 40 in plan view.

The solar cell 581 is arranged in a region from an approximate position at seven o'clock to an approximate position at nine o'clock along the outer circumference of the solar panel 25E.

The solar cell 582 is arranged in a region from an approximate position at nine o'clock to an approximate position at eleven o'clock along the outer circumference of the solar panel 25E.

The solar cell 583 is arranged on the inner circumferential side of the solar cells 581, 582, and 584, and is arranged on a side of the first virtual straight line L1 at nine o'clock, that is, in a left half region in FIG. 10.

The solar cell 584 is arranged in a region from an approximate position in the middle between five o'clock and six o'clock to an approximate position at seven o'clock along the outer circumference of the solar panel 25E.

The solar cell 585 is arranged on the inner circumferential side of the solar cells 584, 586, and 587, and is arranged on a side of the first virtual straight line L1 at three o'clock, that is in a right half region in FIG. 10.

The solar cell 586 is arranged in a region from an approximate position at one o'clock to an approximate position at four o'clock along the outer circumference of the solar panel 25E.

The solar cell 587 is arranged in a region from an approximate position at four o'clock to an approximate position in the middle between five o'clock and six o'clock along the outer circumference of the solar panel 25E.

The solar cells 581 to 587 are set so that variation in effective power generation area falls within a certain range.

An outer edge 582A of the solar cell 582, which extends along the planar antenna 40, is formed linearly so as to be substantially parallel with the first side surface 413A.

Outer edges 583A and 585A of the solar cell 583 and the solar cell 585, which extend along the planar antenna 40, are formed linearly so as to be substantially parallel with the fourth side surface 413D.

An outer edge of 586A of the solar cell 586, which extends along the planar antenna 40, is formed linearly so as to be substantially parallel with the second side surface 413B.

Thus, a length of the circumferences of the solar cell 582 and the solar cell 583 that are connected in series, which extend along the outer circumference of the antenna electrode 42, that is, a dimension obtained by summing up all the circumferential lengths of the outer edge 582A and the outer edge 583A, and a length of the circumferences of the solar cell 585 and the solar cell 586 that are connected in series, which extend along the outer circumference of the antenna electrode 42, that is, a dimension obtained by summing up all the circumferential lengths of the outer edge 585A and the outer edge 586A are the same dimension, and are not more than a half of the outer circumferential length of the planar antenna 40.

Next, description is made on a charge route of the secondary battery 24 with the solar cells 581 to 587.

Similarly to the solar panel 25, the electrode terminals 271 and 272 are provided on the outer circumferential end of the solar panel 25E, and the solar cells 581 to 587 are connected in series between the electrode terminals 271 and 272.

The electrode terminal 271 is conducted to one electrode of the metal electrode and the transparent electrode of the solar cell 581, and the electrode terminal 272 is conducted to another electrode of the metal electrode and the transparent electrode of the solar cell 587. Further, similarly in the first exemplary embodiment, the electrode terminals 271 and 272 are conducted to the secondary battery 24 via the first conduction spring 281, the second conduction spring 282, and the second circuit board 724.

Similarly to the first exemplary embodiment, the solar cells 581 to 587 are connected in series with connection portions 591 to 596.

The connection portion 591 electrically connects the solar cell 581 and the solar cell 582 in series. The connection portion 592 electrically connects the solar cell 582 and the solar cell 583 in series. The connection portion 593 electrically connects the solar cell 583 and the solar cell 584 in series. The connection portion 594 electrically connects the solar cell 584 and the solar cell 585 in series. The connection portion 595 electrically connects the solar cell 585 and the solar cell 586 in series. The connection portion 596 electrically connects the solar cell 586 and the solar cell 587 in series.

Of the four solar cells 582, 583, 585, and 586, which are arranged along the outer circumference of the antenna electrode 42 of the planar antenna 40, the solar cell 582 and the solar cell 583 and the solar cell 585 and the solar cell 586 are directly connected to each other with the connection portions 592 and 595.

The solar cell 583 and the solar cell 585 are not directly connected to each other, and are connected in series via the solar cell 584 that is not arranged along the outer circumference of the antenna electrode 42. Therefore, the solar cell 583 and the solar cell 585 form a first solar cell and a second solar cell, and the solar cell 584 forms a third solar cell.

the connection portions 591 and 596 are provided along the outer circumference of the solar panel 25E, and are arranged at positions overlapping the dial ring 32 in plan view.

The connection portions 592 and 595 are arranged at positions, which overlap with the pointer shafts inserted through the holes 257 and 258, in plan view.

The connection portions 593 and 594 are arranged so as to overlap with the pointers mounted to the pointer shaft inserted through the hole 259 and the applied ring of the sub-dial in plan view.

Therefore, the connection portions 591 to 596 are arranged so as to be less noticeable when the dial 2 is visually recognized.

In a case where the solar panel 25E is divided into the four regions 201A, 201B, 202A, and 202B with the first virtual straight line L1 and the second virtual straight line L2 similarly in, the first exemplary embodiment, the electrode terminal 271 and the first conduction spring 281 are arranged in the region 202A, and the electrode terminal 272 and the second conduction spring 282 are arranged in the region 202B similarly in the first exemplary embodiment.

The fifth exemplary embodiment as described above can also exert effects similar to those in the first exemplary embodiment.

Further, the seven solar cells 581 to 587 are connected in series on the solar panel 25D. Thus, as compared to the solar panel 25, 25B, 25C, and 25D in the exemplary embodiments in which the eight or nine solar cells are connected in series, an average effective power generation area of the solar cells can be increased, and the minimum effective power generation area of the solar cell among the solar cell 581 to 587 that are connected in series can be increased. As a result, an amount of power generation can be increased.

Sixth Exemplary Embodiment

Figure 11:
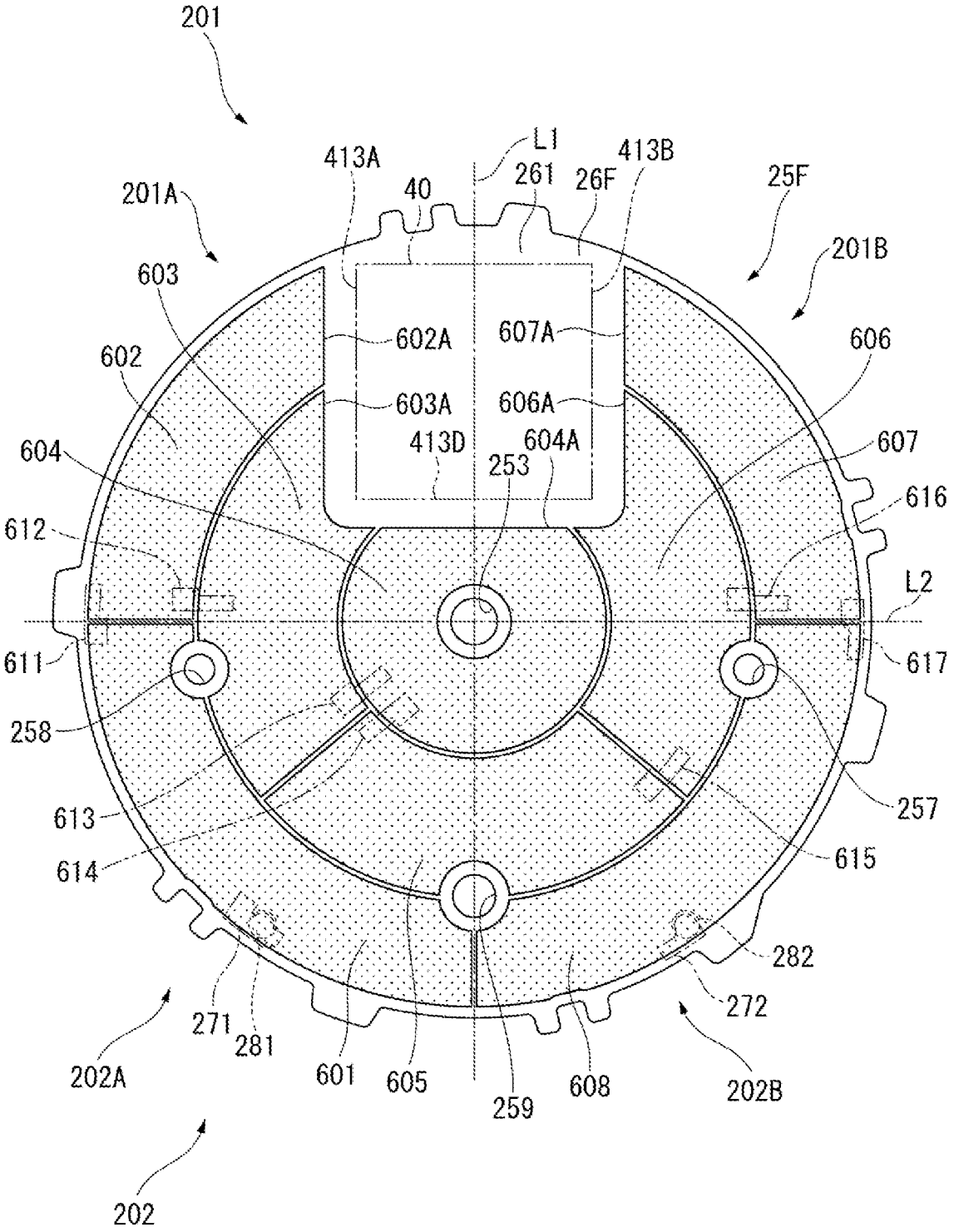
FIG. 11 is a plan view illustrating a solar panel in a sixth exemplary embodiment.

Next, with reference to FIG. 11, description is made on a solar panel 25F in a sixth exemplary embodiment. The solar panel 25F is provided to a watch including the sub-dial similar in the electronic watch 1 according to the first exemplary embodiment. Thus, similarly to the solar panel 25, the holes 253, 257, 258, and 259 through which the pointer shafts are inserted are formed in the solar panel 25F. Note that, components of the sixth exemplary embodiment that are identical or similar to the corresponding components of the first exemplary embodiment are denoted by identical reference signs and that description for these components is omitted.

Similarly to the base 26C in the third exemplary embodiment, a portion of a base 26F of the solar panel 25F in the sixth embodiment, which does not overlap with the planar antenna 40 in plan view, is not cut out, and the antenna cover potion 261 that covers the planar antenna 40 is formed. Also on the base 26F, the entire antenna cover potion 261 also functions as a signal passing part.

Eight solar cells including a solar cell 601 to a solar cell 608 connected in series are provided on the base 26F. The four solar cells including the solar cell 601, the solar cell 602, the solar cell 607, and the solar cell 608 are arranged along the outer circumference of the solar panel 25F. The three solar cells including the solar cell 603, the solar cell 605, and the solar cell 606 are arranged on the inner circumferential side of those four solar cells. The solar cell 604 is arranged on the inner circumferential side of those three solar cells.

Here, the four solar cells 601, 602, 607, and 608, which are arranged on the outermost circumference of the solar panel 25F, formed substantially in an annular fan shape with division lines along the first virtual straight line L1 and the second virtual straight line L2 and a division line provided in an arc shape with the center of the solar panel 25F as the center point. The three solar cell 603, 605, and 606, which are provided at the second from the outer circumference of the solar panel 25F, are formed substantially in an annular fan shape with division lines provided radially from the center of the solar panel 25F and a division line provided in an arc shape with the center as the center point described above. The solar cell 604 provided on the innermost circumference of the solar panel 25F is formed substantially in an annular shape in the periphery of the hole 253.

However, the solar cells 602, 603, 604, 606, and 607 have a planer shape prevented from being provided in a region overlapping with the planar antenna 40 in plan view.

The solar cell 601 is arranged in a region from a position at six o'clock to a position at nine o'clock along the outer circumference of the solar panel 25F.

The solar cell 602 is arranged in a region from a position at nine o'clock to an approximate position at eleven o'clock along the outer circumference of the solar panel 25F.

The solar cell 603 is arranged in a region from an approximate position at eight o'clock to an approximate position at eleven o'clock along the inner circumference of the solar cells 601 and 602.

The solar cell 604 is arranged on the inner circumference of the solar cells 603, 605, and 606.

The solar cell 605 is arranged in a region from an approximate position at four o'clock to an approximate position at eight o'clock along the inner circumference of the solar cells 601 and 608.

The solar cell 606 is arranged in a region from an approximate position at one o'clock to an approximate position at four o'clock along the inner circumference of the solar cells 607 and 608.

The solar cell 607 is arranged in a region from an approximate position at one o'clock to a position at three o'clock along the outer circumference of the solar panel 25F.

The solar cell 608 is arranged in a region from a position at three o'clock to a position at six o'clock along the outer circumference of the solar panel 25F.

The solar cells 601 to 608 are set so that variation in effective power generation area falls within a certain range.

An outer edge 602A of the solar cell 602, which extends along the planar antenna 40, is formed linearly so as to be substantially parallel with the first side surface 413A.

An outer edge 603A of the solar cell 603, which extends along the planar antenna 40, is formed so as to have a linear part substantially parallel with the first side surface 413A, a linear part substantially parallel with the fourth side surface 413D, and a curved part connecting the linear parts with each other.

An outer edge of 604A of the solar cell 604, which extends along the planar antenna 40, is formed linearly so as to be substantially parallel with the fourth side surface 413D.

An outer edge 606A of the solar cell 606, which extends along the planar antenna 40, is formed to have a linear part substantially parallel with the second side surface 413B, a linear part substantially parallel with the fourth side surface 413D, and a curved part connecting the linear parts with each other.

An outer edge of 607A of the solar cell 607, which extends along the planar antenna 40, is formed linearly so as to be substantially parallel with the second side surface 413B.

Thus, a length of the circumferences of the solar cell 602, the solar cell 603, and the solar cell 604 that are connected in series, which extend along the outer circumference of the antenna electrode 42, that is, a dimension obtained by summing up all the circumferential lengths of the outer edges 602A, 603A, and 604A is not more than a half of the outer circumferential length of the planar antenna 40. Similarly, a length of the circumferences of the solar cell 606 and the solar cell 607 that are connected in series, which extend along the outer circumference of the antenna electrode 42, that is, a dimension obtained by summing up all the circumferential lengths of the outer edge 606A and the outer edge 607A is not more than a half of the outer circumferential length of the planar antenna 40.

Next, description is made on a charge route of the secondary battery 24 with the solar cells 601 to 608.

Similarly to the solar panel 25, the electrode terminals 271 and 272 are provided on the outer circumferential end of the solar panel 25F, and the solar cells 601 to 608 are connected in series between the electrode terminals 271 and 272.

The electrode terminal 271 is conducted to one electrode of the metal electrode and the transparent electrode of the solar cell 601, and the electrode terminal 272 is conducted to another electrode of the metal electrode and the transparent electrode of the solar cell 608. Further, similarly in the first exemplary embodiment, the electrode terminals 271 and 272 are conducted to the secondary battery 24 via the first conduction spring 281, the second conduction spring 282, and the second circuit board 724.

Similarly to the first exemplary embodiment, the solar cells 601 to 608 are connected in series with connection portions 611 to 617.

The connection portion 611 electrically connects the solar cell 601 and the solar cell 602 in series. The connection portion 612 electrically connects the solar cell 602 and the solar cell 603 in series. The connection portion 613 electrically connects the solar cell 603 and the solar cell 604 in series. The connection portion 614 electrically connects the solar cell 604 and the solar cell 605 in series. The connection portion 615 electrically connects the solar cell 605 and the solar cell 606 in series. The connection portion 616 electrically connects the solar cell 606 and the solar cell 607 in series. The connection portion 617 electrically connects the solar cell 607 and the solar cell 608 in series.

Of the five solar cells 602, 603, 604, 606, and 607, which are arranged along the outer circumference of the antenna electrode 42 of the planar antenna 40, the solar cell 602, the solar cell 603, and the solar cell 604 are sequentially connected in series with the connection portions 612 and 613. Further, the solar cell 606 and the solar cell 607 are directly connected to each other with the connection portion 616.

The solar cell 604 and the solar cell 606 are not directly connected to each other, and are connected in series via the solar cell 605 that is not arranged along the outer circumference of the antenna electrode 42. Therefore, the solar cell 604 and the solar cell 606 form a first solar cell and a second solar cell, and the solar cell 605 forms a third solar cell.

The connection portion 611 and 617 are provided along the outer circumference of the solar panel 25F, and are arranged at positions overlapping with the dial ring 32 in plan view.

The connection portions 612 and 616 are arranged at positions, which overlap with the pointer shafts inserted through the holes 257 and 258, in plan view.

Therefore, the connection portions 611, 612, 616, and 617 are arranged so as to be less noticeable when the dial 2 is visually recognized.

In a case where the solar panel 25F is divided into the four regions 201A, 201B, 202A, and 202B with the first virtual straight line L1 and the second virtual straight line L2 similarly in, the first exemplary embodiment, the electrode terminal 271 and the first conduction spring 281 are arranged in the region 202A, and the electrode terminal 272 and the second conduction spring 282 are arranged in the region 202B similarly in the first exemplary embodiment.

The sixth exemplary embodiment as described above can also exert effects similar to those in the first exemplary embodiment.

Further, on the solar panel 25F, the solar cell 604 surrounds the periphery of the hole 253, and a division line for the solar cells is not provided. Thus, design of the solar panel 25F can be improved.

Further, the division lines for the solar cells 601, 602, 607, and 608 on the outermost circumference and the division lines for the solar cells 603, 605, and 606 provided at the second from the outer circumference are not continuous in a radial direction of the solar panel 25F. Thus, the division lines are less noticeable to improve design of the solar panel 25F.

Other Exemplary Embodiments

Note that, the present disclosure is not limited to the exemplary embodiments, and various changes can be made within the scope of the present disclosure.

Figure 12:
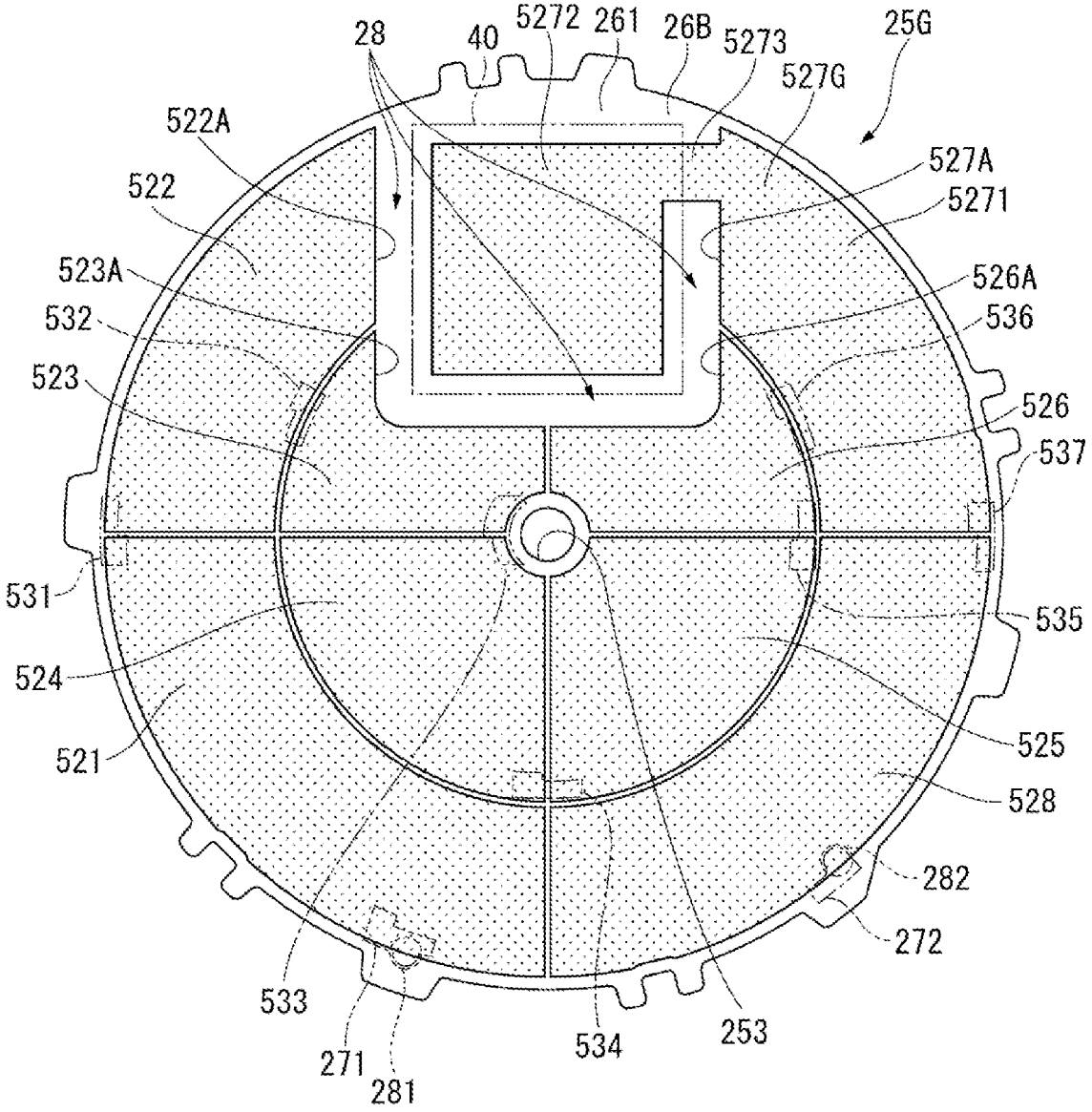
FIG. 12 is a plan view illustrating a solar panel in a modification example.

In each of the exemplary embodiments, a solar cell is not arranged in the antenna cover potion 261 being a region overlapping with the planar antenna 40 in plan view. However, as illustrated in FIG. 12, a solar cell may be arranged so as to overlap with the planar antenna 40 in plan view. Note that, a solar panel 25G illustrated in FIG. 12 is obtained with the solar panel 25B illustrated in FIG. 7 as the base, and the only difference therebetween is a solar cell 527G. Thus, components on the solar panel 25G that are identical or similar to the corresponding components of the solar panel 25B are denoted by identical reference signs, and description for these components is omitted.

The solar cell 527G is formed to have a cell body part 5271, an extended part 5272 formed in a region overlapping with the planar antenna 40 in plan view, and a coupling part 5273 that couples the cell body part 5271 and the extended part 5272.

Similarly to the solar cell 527 on the solar panel 25B, the cell body part 5271 is formed in an annular fan shape from an approximate position at one o'clock to a position at three o'clock. The extended part 5272 overlaps with the planar antenna 40 in plan view, and is formed in a size slightly smaller than the planar antenna 40. Thus, between the extended part 5272, and the outer edge 522A of the solar cell 522, the outer edge 523A of the solar cell 523, the outer edge 526A of the solar cell 526, and the outer edge 527A, a signal passing part 28 in which a cell is not formed is formed.

The signal passing part 28 is formed so as to overlap with the edge of the antenna electrode 42 in plan view. As illustrated in FIG. 5, an electric field is stronger along the edge of the antenna electrode 42 of the planar antenna 40. Thus, when a metal layer such as a solar cell is arranged so as to overlap a portion along the edge of the antenna electrode 42, a radio wave is blocked to degrade reception performance drastically. Meanwhile, even when the extended part 5272 of the solar cell 527 is arranged in a region on the inner side of the edge of the antenna electrode 42, that is, on the center side of the antenna electrode 42, influence on reception performance is small. Thus, the extended part 5272 is provided so as to form the signal passing part 28. In this manner, influence on reception performance of the planar antenna 40 is suppressed, and an effective power generation area of the solar cell can be increased. Further, the coupling part 5273 overlaps with the edge of the antenna electrode 42. However, a width dimension thereof, that is, a dimension thereof in a direction along the outer edge 527A is small, and hence influence on reception performance can be small.

Further, also on the other solar panels 25, 25C, 25D, 25E, and 25F similarly to the solar panel 25G, a signal passing part may be provided, and a solar cell may be arranged at a position overlapping with the planar antenna 40 in plan view.

Further, on the solar panel 25G, a part of the solar cell 527 is formed in a region overlapping with the planar antenna 40 in plan view. However, parts of the solar cell 522, the solar cell 523, and the solar cell 526 may be formed. Further, parts of the solar cell 522 and the solar cell 527 may be formed in a region overlapping with the planar antenna 40 in plan view.

The position at which the planar antenna 40 is arranged in the outer case 10 is not limited to the side in the direction pointing to twelve o'clock with respect to the center of the dial 2. The direction pointing to six o'clock, that is, the center position of the planar antenna 40 may fall within an angular range between a direction pointing to five o'clock and a direction pointing to seven o'clock with respect to the plane center of the outer case 10. Further, the position at which the planar antenna 40 is arranged may be on a side in a direction pointing to three o'clock with respect to the center of the dial 2 (the center position of the planar antenna 40 falls within an angular range between a direction pointing to two o'clock and a direction pointing to four o'clock), or on a side in a direction pointing to nine o'clock (the center position of the planar antenna 40 falls within an angular range between a direction pointing to eight o'clock to a direction pointing to ten o'clock).

The configurations of the planar antenna 40 and the circuit boards 723 and 724 are not limited to the exemplary embodiments. For example, with regard to the planar antenna 40, the antenna electrode 42 laminated on the front surface of the dielectric base material 41 may be formed so as to be shifter in a direction away from the metal parts arranged on the watch front side with respect to the planar antenna 40.

Similarly to the solar panel 25, each of the solar panel 25B, 25C, 25D, 25E, 25F, and 25G may not include an antenna cover portion but include the cutout 251 formed in a portion overlapping with the planar antenna 40 in plan view.

Further, a shape or arrangement of the solar cells on the solar panel are not limited to those in each of the exemplary embodiments. It is only required to adopt a configuration in which the first and second solar cells, which are arranged continuously along the outer circumference of the antenna electrode 42, and the third solar cell, which is arranged so that at least one solar cell of the first and second solar cells is positioned between the third solar cell and the outer circumference of the antenna electrode 42, are included, and a configuration in which the first solar cell is connected to the second solar cell in series via the third solar cell.

In each of the exemplary embodiments, the four or five solar cells are arranged along the antenna electrode 42. However, two or three solar cells may be arranged, or six or more solar cells may be arranged.

In the exemplary embodiments, the connection portions of the solar cells are arranged at positions overlapping with any one of the applied characters, the simplified characters, the applied ring, and the pointer shaft in plan view, but are not limited to the arrangement at those positions. Note that, in a case where a component that covers the connection portion is not provided, the connection portion may be less noticeably by performing printing at a position overlapping the connection portion on the dial 2 in order to make the connection portion less noticeable.

Description is made on a GPS satellite as an example of a position information satellite, but the present disclosure is not limited thereto. For example, as a position information satellite, other satellites such as Galileo (EU), GLONASS (Russia), and Beidou (China), which are used in Global Navigation Satellite System (GNSS), may be applied. Further, a geostationary satellite in, for example, a Satellite-based Augmentation System (SBAS) and a quasi-zenith satellite in a radionavigation-satellite service (RNSS) that can perform searching in a specified region may be applied.

The planar antenna 40 is not limited to the patch antenna described above, and may adopt a planar antenna of other kinds such as a chip antenna and an inverted F antenna. An appropriate planar antenna may be used in accordance with a kind of a signal to be received. Further, a planar shape of the planar antenna 40, that is, a shape of the antenna in plan view is not limited to a quadrangular shape, and may be a circular shape.

A usage purpose of the antenna is not limited to reception of a satellite signal, and may be used for reception of a signal such as Wi-Fi (trademark), Bluetooth (trademark) Low Energy (BLE), and Low Power Wide Area (LPWA).

What is claimed is:

1. An electronic watch, comprising:

a dial;

an antenna being arranged to overlap with the dial in a plan view as seen in a vertical direction with respect to a front surface of the dial, the antenna including a dielectric base and an antenna electrode arranged at a front surface of the dielectric base;

a solar panel including:

a first solar cell and a second solar cell being arranged to overlap with the dial in plan view and arranged continuously along an outer circumference of the antenna electrode; and a third solar cell being arranged so that at least one of the first solar cell and the second solar cell is positioned between the third solar cell and the outer circumference of the antenna electrode, the first solar cell being connected to the second solar cell in series via the third solar cell;

a circuit board being arranged to overlap with the dial in plan view; and a connection member connecting the solar panel and the circuit board, the connection member being arranged in a first region different from a second region in which the antenna is arranged when the dial is divided into the first and second regions by a second virtual straight line being orthogonal to a first virtual straight line and passing through a center of the dial, the first virtual straight line passing through a center of the antenna electrode and the center of the dial in plan view.

2. The electronic watch according to claim 1, wherein at least one other solar cell is arranged along the outer circumference of the antenna electrode in addition to the first solar cell and the second solar cell.

3. The electronic watch according to claim 2, wherein a length dimension of outer edges of solar cells, which extends along the outer circumference of the antenna electrode, is not more than a half of an outer circumferential length of the antenna, the solar cells being directly connected to each other and being arranged along the outer circumference of the antenna electrode.

4. The electronic watch according to claim 1, wherein a connection portion connecting the solar cells in series are arranged at a position overlapping with any of an applied character, a simplified character, an applied ring, a dial ring, and a pointer shaft in plan view.

5. The electronic watch according to claim 1, wherein the solar panel includes an antenna cover portion overlapping with the antenna in plan view, and the antenna cover portion includes a signal passing part through which a signal to be received by the antenna passes.

6. The electronic watch according to claim 1, wherein, at the solar panel, a difference in an effective power generation area of a power generation layer between one of the first, second and third solar cells that includes a power generation layer having a minimum effective power generation area and another of the first, second and third solar cells that includes a power generation layer having a maximum effective power generation area, is equal to or smaller than a preset value.

7. The electronic watch according to claim 1, wherein the antenna is a patch antenna.

* * * * *